US011514856B2

(12) United States Patent
Yang et al.

(10) Patent No.: US 11,514,856 B2
(45) Date of Patent: Nov. 29, 2022

(54) PIXEL CIRCUIT AND DRIVING METHOD THEREFOR, DISPLAY SUBSTRATE, AND DISPLAY PANEL

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventors: Huijuan Yang, Beijing (CN); Tingliang Liu, Beijing (CN); Bo Zhang, Beijing (CN); Yiran Li, Beijing (CN); Lianbin Liu, Beijing (CN)

(73) Assignee: BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 0 days.

(21) Appl. No.: 17/273,614

(22) PCT Filed: Jul. 16, 2020

(86) PCT No.: PCT/CN2020/102235
§ 371 (c)(1),
(2) Date: Mar. 4, 2021

(87) PCT Pub. No.: WO2021/017840
PCT Pub. Date: Feb. 4, 2021

(65) Prior Publication Data

US 2022/0051627 A1 Feb. 17, 2022

(30) Foreign Application Priority Data

Jul. 31, 2019 (CN) ..... 201910702440.4

(51) Int. Cl.
*G09G 3/3258* (2016.01)
*G09G 3/3266* (2016.01)

(52) U.S. Cl.
CPC ..... *G09G 3/3258* (2013.01); *G09G 3/3266* (2013.01); *G09G 2300/0452* (2013.01); (Continued)

(58) Field of Classification Search
None
See application file for complete search history.

(56) References Cited

U.S. PATENT DOCUMENTS 10,004,124 B1 * 6/2018 Ko ..... H05B 33/10
10,699,642 B2 * 6/2020 Ma ..... H01L 51/5056
(Continued)

*Primary Examiner* — Nitin Patel
*Assistant Examiner* — Amen W Bogale
(74) *Attorney, Agent, or Firm* — Scully Scott Murphy & Presser

(57) ABSTRACT

A pixel circuit and a driving method thereof, a display substrate, and a display panel are provided. The pixel circuit includes: a data writing sub-circuit configured to write a data voltage into a storage sub-circuit; the storage sub-circuit configured to store the data voltage; a driving sub-circuit electrically connected to a first node and configured to drive a light-emitting component electrically connected to a second node to emit light according to the data voltage; a light-emitting control sub-circuit electrically connected to the first node and the second node, respectively, and configured to achieve to turn on or turn off connection between the driving sub-circuit and the light-emitting component; and a first compensation sub-circuit electrically connected to the first node and the second node, respectively, and configured to compensate a level of the second node according to a level of the first node.

18 Claims, 7 Drawing Sheets

(52) U.S. Cl.
CPC ..... *G09G 2300/0819* (2013.01); *G09G 2300/0852* (2013.01); *G09G 2310/0286* (2013.01)

(56) References Cited

U.S. PATENT DOCUMENTS

| | | | | |
|---|---|---|---|---|
| 11,189,225 | B1 * | 11/2021 | Heganovic | G09G 3/3233 |
| 2009/0206764 | A1 * | 8/2009 | Schemmann | H02H 9/001 315/241 R |
| 2012/0038606 | A1 * | 2/2012 | Kang | G09G 3/3233 345/204 |
| 2014/0292736 | A1 * | 10/2014 | Tseng | G09G 3/3241 345/211 |
| 2014/0347337 | A1 * | 11/2014 | Uchino | G09G 3/30 345/76 |
| 2015/0287360 | A1 * | 10/2015 | Yin | H01L 27/3265 345/212 |
| 2015/0348464 | A1 * | 12/2015 | In | G09G 3/2022 345/82 |
| 2017/0124953 | A1 * | 5/2017 | Shim | G09G 3/3233 |
| 2018/0088260 | A1 * | 3/2018 | Jin | H01L 27/3218 |
| 2020/0006401 | A1 * | 1/2020 | Hwang | G09G 3/3225 |
| 2021/0111227 | A1 * | 4/2021 | Tsuboi | H01L 27/3262 |
| 2022/0093045 | A1 * | 3/2022 | Huangfu | G09G 3/3291 |

* cited by examiner

PIXEL CIRCUIT AND DRIVING METHOD THEREFOR, DISPLAY SUBSTRATE, AND DISPLAY PANEL

CROSS-REFERENCE TO RELATED APPLICATIONS APPLICATION

The present application is a national phase entry of PCT International Application No. PCT/CN2020/102235, filed on Jul. 16, 2020, which claims priority to Chinese Patent Application No. 201910702440.4, filed on Jul. 31, 2019. The entire contents of PCT International Application No. PCT/CN2020/102235 and Chinese Patent Application No. 201910702440.4 are incorporated herein by reference as part of the present application for all purposes.

TECHNICAL FIELD

Embodiments of the present disclosure relate to a pixel circuit and a driving method thereof, a display substrate, and a display panel.

BACKGROUND

With the rapid development of an active-matrix organic light-emitting diode (AMOLED) in a display field, people have higher and higher requirements for display effects. Due to the advantages of high display quality, an application range of high-resolution display devices is becoming wider and wider. Generally, the resolution of the display device can be improved by reducing the size of the pixel and reducing the spacing among pixels.

SUMMARY

At least one embodiment of the present disclosure provides a pixel circuit, comprising: a driving sub-circuit, a light-emitting control sub-circuit, a data writing sub-circuit, a storage sub-circuit, and a first compensation sub-circuit, the data writing sub-circuit is configured to write a data voltage into the storage sub-circuit under control of a scan signal; the storage sub-circuit is configured to store the data voltage; the driving sub-circuit is electrically connected to a first node, a light-emitting component is electrically connected to a second node, the driving sub-circuit is configured to drive the light-emitting component to emit light according to the data voltage; the light-emitting control sub-circuit is electrically connected to the first node and the second node, respectively, and the light-emitting control sub-circuit is configured to achieve to turn on or turn off connection between the driving sub-circuit and the light-emitting component; and the first compensation sub-circuit is electrically connected to the first node and the second node, respectively, and is configured to compensate a level of the second node according to a level of the first node.

For example, in the pixel circuit provided by at least one embodiment of the present disclosure, the first compensation sub-circuit comprises a first capacitor, a first end of the first capacitor is electrically connected to the first node, and a second end of the first capacitor is electrically connected to the second node.

For example, in the pixel circuit provided by at least one embodiment of the present disclosure, the light-emitting control sub-circuit comprises a light-emitting control transistor, a first electrode of the light-emitting control transistor is electrically connected to the first node, a second electrode of the light-emitting control transistor is electrically connected to the second node, and a gate electrode of the light-emitting control transistor is configured to receive a light-emitting control signal.

For example, in the pixel circuit provided by at least one embodiment of the present disclosure, the driving sub-circuit comprises a driving transistor, a first electrode of the driving transistor is electrically connected to a first power terminal, a second electrode of the driving transistor is electrically connected to the first node, a gate electrode of the driving transistor is electrically connected to a third node.

For example, in the pixel circuit provided by at least one embodiment of the present disclosure, the data writing sub-circuit comprises a data writing transistor, the storage sub-circuit comprises a second capacitor, a first electrode of the data writing transistor is configured to receive the data voltage, a second electrode of the data writing transistor is electrically connected to a first end of the second capacitor, a gate electrode of the data writing transistor is configured to receive the scan signal; and a second end of the second capacitor is electrically connected to the third node.

For example, the pixel circuit provided by at least one embodiment of the present disclosure further comprises a second compensation sub-circuit, the second compensation sub-circuit is configured to receive a threshold compensation control signal, and write a threshold compensation voltage to the third node according to the threshold compensation control signal.

For example, the pixel circuit provided by at least one embodiment of the present disclosure further comprises a reference voltage writing sub-circuit, the reference voltage writing sub-circuit is configured to receive a reference voltage control signal, and write a reference voltage to the first end of the second capacitor according to the reference voltage control signal.

For example, the pixel circuit provided by at least one embodiment of the present disclosure further comprises a first reset sub-circuit, the first reset sub-circuit is configured to receive a first reset control signal and write a first reset voltage to the third node according to the first reset control signal.

For example, the pixel circuit provided by at least one embodiment of the present disclosure further comprises a second reset sub-circuit, the second reset sub-circuit is configured to receive a second reset control signal and write a second reset voltage to the first end of the second capacitor according to the second reset control signal.

For example, the pixel circuit provided by at least one embodiment of the present disclosure further comprises a second compensation sub-circuit, a reference voltage writing sub-circuit, a first reset sub-circuit, and a second reset sub-circuit, the first compensation sub-circuit comprises a first capacitor, the light-emitting control sub-circuit comprises a light-emitting control transistor, the driving sub-circuit comprises a driving transistor, the data writing sub-circuit comprises a data writing transistor, the storage sub-circuit comprises a second capacitor, the second compensation sub-circuit comprises a threshold compensation transistor, the reference voltage writing sub-circuit comprises a reference voltage writing transistor, the first reset sub-circuit comprises a first reset transistor, the second reset sub-circuit comprises a second reset transistor, a first end of the first capacitor is electrically connected to the first node, a second end of the first capacitor is electrically connected to the second node, a first electrode of the light-emitting control transistor is electrically connected to the first node, a second electrode of the light-emitting control transistor is electrically connected to the second node, and a gate electrode of the light-emitting control transistor is configured to receive a light-emitting control signal; a first electrode of the driving transistor is electrically connected to a first power terminal, a second electrode of the driving transistor is electrically connected to the first node, and a gate electrode of the driving transistor is electrically connected to a third node; a first light-emitting voltage applying electrode of the light-emitting component is electrically connected to the second node, and a second light-emitting voltage applying electrode of the light-emitting component is electrically connected to a second power terminal, a first electrode of the data writing transistor is configured to receive the data voltage, a second electrode of the data writing transistor is electrically connected to a first end of the second capacitor, and a gate electrode of the data writing transistor is configured to receive the scan signal, a second end of the second capacitor is electrically connected to the third node, a first electrode of the threshold compensation transistor is electrically connected to the first node, a second electrode of the threshold compensation transistor is electrically connected to the third node, and a gate electrode of the threshold compensation transistor is configured to receive a threshold compensation control signal; a first electrode of the reference voltage writing transistor is configured to receive a reference voltage, a second electrode of the reference voltage writing transistor is electrically connected to the first end of the second capacitor, and a gate electrode of the reference voltage writing transistor is configured to receive a reference voltage control signal; a first electrode of the first reset transistor is configured to receive a first reset voltage, a second electrode of the first reset transistor is electrically connected to the third node, and a gate electrode of the first reset transistor is configured to receive a first reset control signal; a first electrode of the second reset transistor is electrically connected to the first power terminal, a second electrode of the second reset transistor is electrically connected to the first end of the second capacitor, and a gate electrode of the second reset transistor is configured to receive a second reset control signal.

At least one embodiment of the present disclosure further provides a display substrate, comprising a base substrate, and the pixel circuit and the light-emitting component according to any one of the above embodiments, the light-emitting component and the pixel circuit are arranged on the base substrate.

For example, in the display substrate provided by at least one embodiment of the present disclosure, in a case where the first compensation sub-circuit comprises a first capacitor, the first capacitor comprises a first electrode and a second electrode, the light-emitting component comprises a first light-emitting voltage applying electrode, a second light-emitting voltage applying electrode, and a light-emitting layer arranged between the first light-emitting voltage applying electrode and the second light-emitting voltage applying electrode, the first electrode of the first capacitor is electrically connected to the first node, the second electrode of the first capacitor is electrically connected to the second node, the second electrode of the first capacitor and the first light-emitting voltage applying electrode are provided integrally, in a direction perpendicular to the base substrate, the first electrode of the first capacitor is located between the first light-emitting voltage applying electrode and the base substrate, and the first light-emitting voltage applying electrode is located between the first electrode of the first capacitor and the light-emitting layer.

For example, in the display substrate provided by at least one embodiment of the present disclosure, an orthographic projection of the first electrode of the first capacitor on the base substrate and an orthographic projection of the first light-emitting voltage applying electrode on the base substrate at least partially overlap.

At least one embodiment of the present disclosure further provides a driving method of the pixel circuit according to any one of the above embodiments, comprising: in a data writing stage, writing the data voltage to the driving sub-circuit, and compensating the level of the second node according to the level of the first node; in a light-emitting stage, driving the light-emitting component to emit light by the driving sub-circuit according to the data voltage.

At least one embodiment of the present disclosure further provides a display panel comprising a base substrate and a plurality of repeating units on the base substrate, each repeating unit in the plurality of repeating units comprises a first sub-pixel and a second sub-pixel, the first sub-pixel comprises a first light-emitting component and a first pixel circuit, the first pixel circuit is the pixel circuit according to any one of the above embodiments, and the first light-emitting component is a light-emitting component driven by the first pixel circuit.

For example, in the display panel provided by at least one embodiment of the present disclosure, the second sub-pixel comprises a second light-emitting component and a second pixel circuit, the second pixel circuit is configured to drive the second light-emitting component to emit, in a direction perpendicular to the base substrate, a driving sub-circuit in the first pixel circuit is located between the first light-emitting component and the base substrate, and a driving sub-circuit in the second pixel circuit is located between the second light-emitting component and the base substrate, an orthographic projection of the driving sub-circuit in the first pixel circuit on the base substrate and an orthographic projection of the first light-emitting component on the base substrate at least partially overlap, and an orthographic projection of the driving sub-circuit in the second pixel circuit on the base substrate and an orthographic projection of the second light-emitting component on the base substrate do not overlap.

For example, in the display panel provided by at least one embodiment of the present disclosure, the orthographic projection of the driving sub-circuit in the first pixel circuit on the base substrate is within the orthographic projection of the first light-emitting component on the base substrate.

For example, in the display panel provided by at least one embodiment of the present disclosure, the each repeating unit further comprises a third sub-pixel and a fourth pixel, the first sub-pixel and the second sub-pixel are both green sub-pixels, the third sub-pixel is a red sub-pixel, and the fourth sub-pixel is a blue sub-pixel.

For example, in the display panel provided by at least one embodiment of the present disclosure, the each repeating unit further comprises a third sub-pixel and a fourth pixel, in the each repeating unit, the first sub-pixel and the second sub-pixel are arranged along a first direction, the third sub-pixel and the fourth sub-pixel are arranged along a second direction, the first direction and the second direction are respectively two directions perpendicular to each other in a same plane.

For example, in the display panel provided by at least one embodiment of the present disclosure, the plurality of repeating units are arranged along the second direction to form a plurality of repeating unit groups, the plurality of repeating unit groups are arranged along the first direction.

For example, in the display panel provided by at least one embodiment of the present disclosure, in a case where the first pixel circuit comprises a first capacitor, a threshold compensation transistor, and a light-emitting control transistor, in the first direction, an orthographic projection of a first electrode of the first capacitor on the base substrate is located between an orthographic projection of a gate electrode of the threshold compensation transistor on the base substrate and an orthographic projection of a gate electrode of the light-emitting control transistor on the base substrate.

BRIEF DESCRIPTION OF THE DRAWINGS

In order to clearly illustrate the technical solutions of the embodiments of the disclosure, the drawings of the embodiments will be briefly described in the following; it is obvious that the described drawings are only related to some embodiments of the disclosure and thus are not limitative to the present disclosure.

DETAILED DESCRIPTION

In order to make objects, technical solutions, and advantages of the embodiments of the present disclosure apparent, the technical solutions of the embodiments of the present disclosure will be described in a clearly and fully understandable way in connection with the drawings related to the embodiments of the present disclosure. Apparently, the described embodiments are just a part but not all of the embodiments of the present disclosure. Based on the described embodiments of the present disclosure, those skilled in the art can obtain other embodiment(s), without any inventive work, which should be within the scope of the present disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the absolute position of the object which is described is changed, the relative position relationship may be changed accordingly.

In order to keep the following descriptions of the embodiments of the present disclosure clear and concise, the present disclosure omits detailed descriptions of some known functions and known components.

Figure 1:
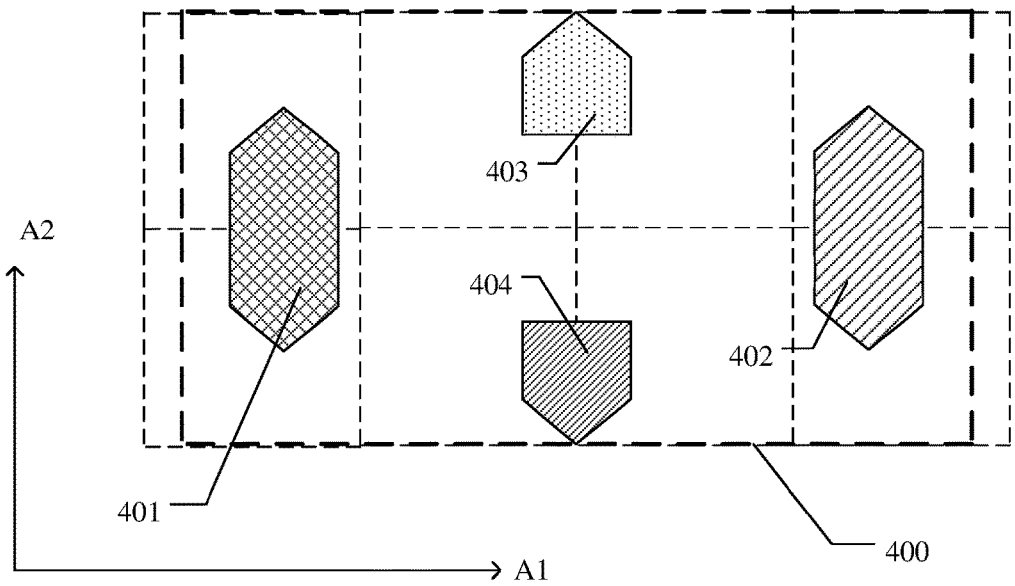
FIG. 1 is a schematic diagram of a structure of a pixel repeating unit in a pixel arrangement structure.
Figure 2:
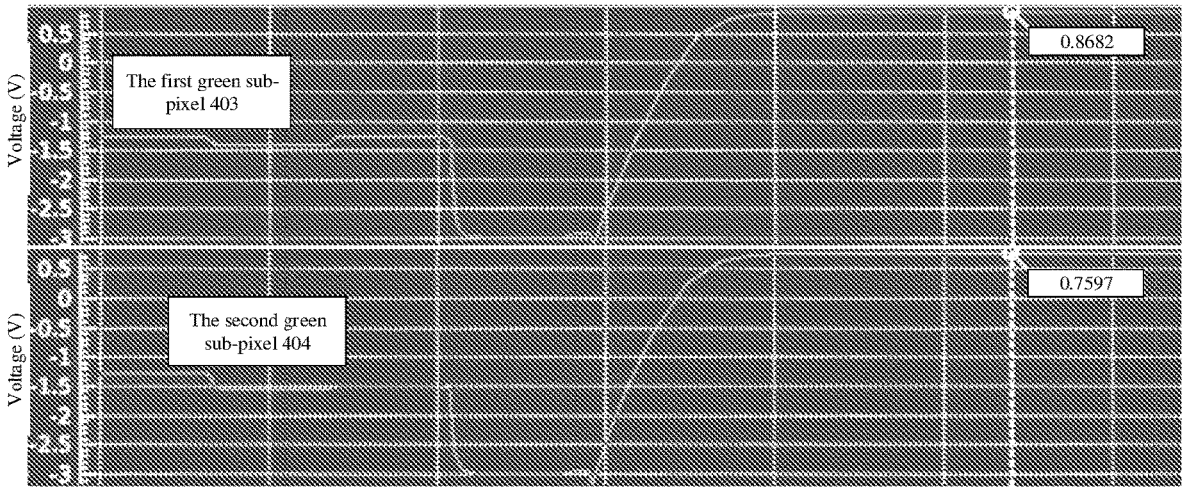
FIG. 2 is a schematic diagram of a detection result of an anode voltage of a first green sub-pixel and a detection result of an anode voltage of a second green sub-pixel in the pixel repeating unit shown in FIG. 1.

FIG. 1 is a schematic diagram of a structure of a pixel repeating unit in a pixel arrangement structure, and FIG. 2 is a schematic diagram of a detection result of an anode voltage of a first green sub-pixel and a detection result of an anode voltage of a second green sub-pixel in the pixel repeating unit shown in FIG. 1. As shown in FIG. 1, a pixel arrangement structure comprises a plurality of pixel repeating units 400 arranged on a base substrate (not illustrated). The plurality of pixel repeating units 400 are arranged in an array along an A1 direction and an A2 direction. Each pixel repeating unit 400 comprises a red sub-pixel 401, a blue sub-pixel 402, a first green sub-pixel 403, and a second green sub-pixel 404. As shown in FIG. 1, the red sub-pixel 401 and the blue sub-pixel 402 are arranged along the A1 direction, the first green sub-pixel 403 and the second green sub-pixel 404 are arranged along the A2 direction, and in the A1 direction, the first green sub-pixel 403 and the second green sub-pixel 404 are located between the red sub-pixel 401 and the blue sub-pixel 402.

In the process of performing lighting detection on respective sub-pixels in the pixel arrangement structure shown in FIG. 1, because the brightness of the first green sub-pixel 403 and the brightness of the second green sub-pixel 404 are inconsistent, thereby leading to the problem of missed detection of bright spots, that is, some green sub-pixels cannot be detected. According to the experimental result, the brightness of the first green sub-pixel 403 is higher than the brightness of the second green sub-pixel 404, so that a phenomenon that the first green sub-pixel 403 is bright and the second green sub-pixel 404 is dark occurs.

By analyzing the pixel arrangement structure, it can be known that in the pixel arrangement structure, an orthographic projection of a gate electrode of a driving transistor in a pixel circuit for driving the first green sub-pixel 403 on the base substrate and an orthographic projection of an anode of a light-emitting component of the first green sub-pixel 403 on the base substrate do not overlap each other, but an orthographic projection of a gate electrode of a driving transistor in a pixel circuit for driving the second green sub-pixel 403 on the base substrate and an orthographic projection of an anode of a light-emitting component of the second green sub-pixel 403 on the base substrate overlap each other. By performing the operation of extracting the 3D capacitance on the first green sub-pixel 403 and the second green sub-pixel 404, it is found that the parasitic capacitance of the first green sub-pixel 403 and the parasitic capacitance of the second green sub-pixel 404 are largely different, which leads to the brightness difference between the first green sub-pixel 403 and the second green sub-pixel 404. As shown in FIG. 2, through the simulation analysis of the first green sub-pixel 403 and the second green sub-pixel 404, it can be seen that the anode voltage of the first green sub-pixel 403 is 0.8682 volts (V), and the anode voltage of the second green sub-pixel 404 is 0.7597V, that is, the anode voltage of the first green sub-pixel 403 is greater than the anode voltage of the second green sub-pixel 404, which causes the brightness of the first green sub-pixel 403 to be higher than that of the second green sub-pixel 404, thereby seriously affecting the display effect.

At least some embodiments of the present disclosure provide a pixel circuit and a driving method thereof, a display substrate, and a display panel. The pixel circuit comprises a driving sub-circuit, a light-emitting control sub-circuit, a data writing sub-circuit, a storage sub-circuit, and a first compensation sub-circuit. The data writing sub-circuit is configured to write a data voltage into the storage sub-circuit under control of a scan signal; the storage sub-circuit is configured to store the data voltage; the driving sub-circuit is electrically connected to a first node, a light-emitting component is electrically connected to a second node, the driving sub-circuit is configured to drive the light-emitting component to emit light according to the data voltage; the light-emitting control sub-circuit is electrically connected to the first node and the second node, respectively, and the light-emitting control sub-circuit is configured to achieve to turn on or turn off the connection between the driving sub-circuit and the light-emitting component; the first compensation sub-circuit is electrically connected to the first node and the second node, respectively, and is configured to compensate a level of the second node according to a level of the first node.

In the pixel circuit, the first compensation sub-circuit is provided between the first node and the second node to achieve to compensate the level of the second node, thereby solving the problem of the difference in pixel brightness of the display panel, and making the pixel brightness of different pixels consistent, and thus improving the display uniformity and the display effect. In addition, the pixel circuit has a simple structure, is easy to design and manufacture, and has low cost.

Several embodiments of the present disclosure will be described in detail below with reference to the accompanying drawings, but the present disclosure is not limited to these specific embodiments.

Figure 3:
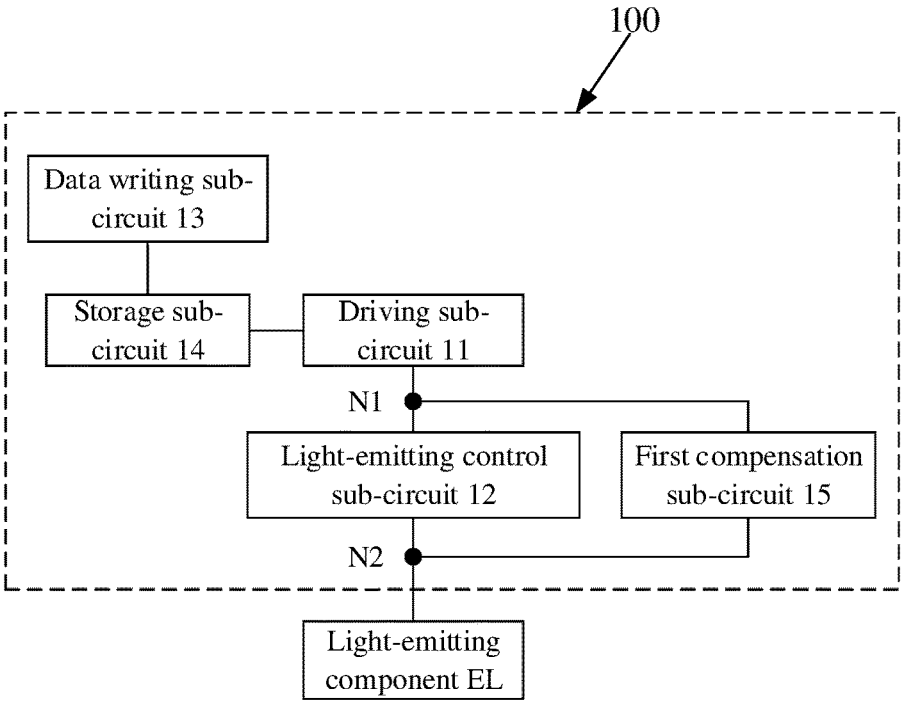
FIG. 3 is a schematic block diagram of a pixel circuit provided by some embodiments of the present disclosure.
Figure 4:
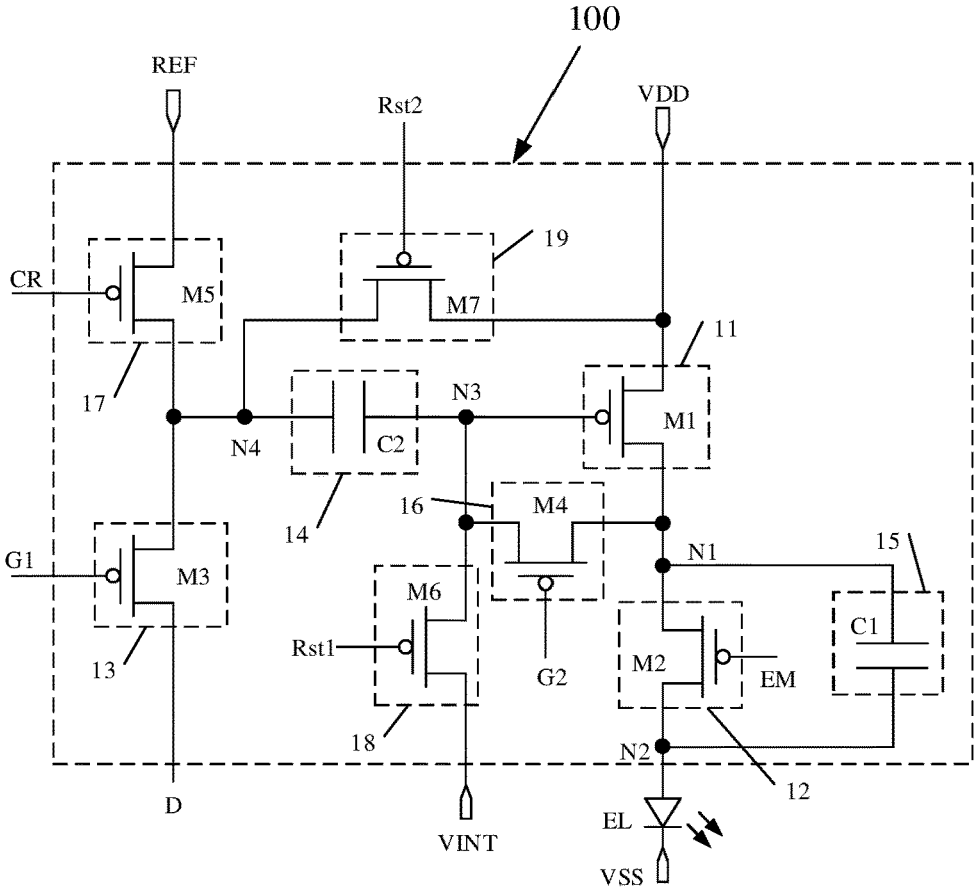
FIG. 4 is a schematic structural diagram of a pixel circuit provided by some embodiments of the present disclosure.

FIG. 3 is a schematic block diagram of a pixel circuit provided by some embodiments of the present disclosure, FIG. 4 is a schematic structural diagram of a pixel circuit provided by some embodiments of the present disclosure.

For example, as shown in FIG. 3, the pixel circuit 100 provided by the embodiments of the present disclosure comprises a driving sub-circuit 11, a light-emitting control sub-circuit 12, a data writing sub-circuit 13, a storage sub-circuit 14, and a first compensation sub-circuit 15. The data writing sub-circuit 13 is configured to write a data voltage into the storage sub-circuit 14 under control of a scan signal. The storage sub-circuit 14 is configured to store the data voltage. The driving sub-circuit 11 is electrically connected to a first node N1, a light-emitting component EL is electrically connected to a second node N2, and the driving sub-circuit 11 is configured to drive the light-emitting component EL to emit light according to the data voltage. The light-emitting control sub-circuit 12 is electrically connected to the first node N1 and the second node N2, respectively, and the light-emitting control sub-circuit 12 is configured to achieve to turn on or turn off the connection between the driving sub-circuit 11 and the light-emitting component EL. The first compensation sub-circuit 15 is electrically connected to the first node N1 and the second node N2, respectively, and is configured to compensate a level of the second node N2 according to a level of the first node N1.

For example, the pixel circuit 100 can be applied to a display panel, such as an active matrix organic light-emitting diode (AMOLED) display panel, etc. The pixel arrangement structure in the AMOLED display panel can be an RGBG pixel arrangement structure to increase the PPI (pixel per inch, the number of pixels per inch) of the display panel, thereby increasing the visual resolution of the display panel in the case where the display resolution is the same. In a case where the pixel circuit 100 is applied to the AMOLED display panel, the problem of the difference in pixel brightness of the display panel can be solved, and the display uniformity and the display effect can be improved.

For example, the light-emitting component EL and the pixel circuit 100 can be arranged on a base substrate.

For example, as shown in FIG. 4, in some embodiments, the first compensation sub-circuit 15 comprises a first capacitor C1. A first end of the first capacitor C1 is electrically connected to the first node N1, and a second end of the first capacitor C1 is electrically connected to the second node N2. In other words, the first compensation sub-circuit 15 can comprise a parasitic capacitor between the first node N1 and the second node N2 (that is, the first capacitor C1 is a parasitic capacitor). Due to the bootstrap effect of the capacitor, the first compensation sub-circuit 15 can control the level of the second node N2 according to the level of the first node N1, to compensate for the influence on the level of the second node N2 due to a factor that the orthographic projection of the driving sub-circuit 11 of the pixel circuit on the base substrate and the orthographic projection of the anode of the light-emitting component EL on the base substrate at least partially overlap, and other factors, and to improve the control of the level of the second node N2, thereby improving the display uniformity and the display effect. For example, compared with a pixel circuit without the first capacitor, the pixel circuit provided by the embodiments of the present disclosure can use the first capacitor C1, for example, to increase the level of the second node N2, thereby increasing the light-emitting brightness of the light-emitting component EL.

For example, a capacitance value of the first capacitor C1 may range from 1 fF to 8 fF.

For example, as shown in FIG. 4, the light-emitting control sub-circuit 12 can comprise a light-emitting control transistor M2. A first electrode of the light-emitting control transistor M2 is electrically connected to the first node N1, a second electrode of the light-emitting control transistor M2 is electrically connected to the second node N2, and a gate electrode of the light-emitting control transistor M2 is configured to be electrically connected to a light-emitting control line EM to receive a light-emitting control signal VEM.

For example, as shown in FIG. 4, the driving sub-circuit 11 comprises a driving transistor M1. A first electrode of the driving transistor M1 is electrically connected to a first power terminal VDD, a second electrode of the driving transistor M1 is electrically connected to the first node N1, and a gate electrode of the driving transistor M1 is electrically connected to a third node M3. In other words, the first end of the first capacitor C1 is electrically connected to the second electrode of the driving transistor M1.

For example, the driving transistor M1 can be a P-type transistor. The first electrode of the driving transistor M1 may be a source electrode and the second electrode of the driving transistor M1 may be a drain electrode, which is described below as an example.

For example, the driving transistor M1 is electrically connected to the light-emitting component EL through the light-emitting control transistor M2. In a case where the light-emitting control transistor M2 is turned on, the connection between the driving transistor M1 and the light-emitting component EL is turned on; in a case where the light-emitting control transistor M2 is turned off, the connection between the driving transistor M1 and the light-emitting component EL is disconnected. For example, in the data writing stage, the light-emitting control transistor M2 can be turned off, so that the light-emitting control transistor M2 can disconnect the connection between the driving transistor M1 and the light-emitting component EL to ensure that the light-emitting component EL does not emit light. But in the light-emitting stage, the light-emitting control line EM can provide the light-emitting control transistor M2 with a light-emitting control signal VEM to turn on the light-emitting control transistor M2, and a light-emitting current can be transmitted to the light-emitting component EL sequentially via the turned-on driving transistor M1 and the turned-on light-emitting control transistor M2 to drive the light-emitting component EL to emit light.

For example, as shown in FIG. 4, a first light-emitting voltage applying electrode of the light-emitting component EL (the anode of the light-emitting component EL in this embodiment) is electrically connected to the second node N2, a second light-emitting voltage applying electrode of the light-emitting component EL (the cathode of the light-emitting component EL in this embodiment) is electrically connected to a second power terminal VSS. That is, the second end of the first capacitor C1 is electrically connected to the first light-emitting voltage applying electrode of the light-emitting component EL.

For example, the light-emitting component EL is configured to receive a light-emitting signal (for example, a current signal) during operation, and emit light of an intensity corresponding to the light-emitting signal. The light-emitting component EL can be a light-emitting diode, the light-emitting diode may be, for example, an organic light-emitting diode (OLED) or a quantum dot light-emitting diode (QLED), etc., but the embodiments of the present disclosure are not limited thereto.

For example, one of the first power terminal VDD and the second power terminal VSS is a high-voltage terminal, and the other is a low-voltage terminal. For example, in the embodiment shown in FIG. 4, the first power terminal VDD is a voltage source to output a constant first voltage, and the first voltage is a positive voltage; and the second power terminal VSS may be a voltage source to output a constant second voltage, and the second voltage is a negative voltage. For example, in some examples, the second power terminal VSS may also be connected to the ground.

For example, as shown in FIG. 4, the data writing sub-circuit 13 comprises a data writing transistor M3. A first electrode of the data writing transistor M3 is configured to receive the data voltage Vdata, a second electrode of the data writing transistor M3 is electrically connected to a fourth node N4, and a gate electrode of the data writing transistor M3 is configured to receive the scan signal Vg1. For example, in some embodiments, the first electrode of the data writing transistor M3 is electrically connected to a data line D to receive the data voltage Vdata, and the gate electrode of the data writing transistor M3 is electrically connected to a gate line G1 to receive the scan signal Vg1.

For example, as shown in FIG. 4, the storage sub-circuit 14 comprises a second capacitor C2, a first end of the second capacitor C2 is electrically connected to the fourth node N4, that is, the second electrode of the data writing transistor M3 is electrically connected to the first end of the second capacitor C2, and a second end of the second capacitor C2 is electrically connected to the third node N3, that is, the second end of the second capacitor C2 is electrically connected to the gate electrode of the driving transistor M1.

For example, the capacitance value of the second capacitor C2 may range from 40 fF to 100 fF.

For example, as shown in FIG. 4, the pixel circuit 100 further comprises a second compensation sub-circuit 16. The second compensation sub-circuit 16 is configured to receive a threshold compensation control signal, and write a threshold compensation voltage to the third node, that is, the gate electrode of the driving transistor, according to the threshold compensation control signal.

For example, the second compensation sub-circuit 16 can comprise a threshold compensation transistor M4. A first electrode of the threshold compensation transistor M4 is electrically connected to the first node N1, that is, the first electrode of the threshold compensation transistor M4 is electrically connected to the second electrode of the driving transistor M1, a second electrode of the threshold compensation transistor M4 is electrically connected to the third node N3, that is, the second electrode of the threshold compensation transistor M4 is electrically connected to the gate electrode of the driving transistor M1, and a gate electrode of the threshold compensation transistor M4 is configured to receive the threshold compensation control signal Vg2. For example, as shown in FIG. 4, the gate electrode of the threshold compensation transistor M4 is electrically connected to a threshold compensation control line G2 to receive the threshold compensation control signal Vg2.

For example, the threshold compensation control signal Vg2 and the scan signal Vg1 can be the same. For example, the gate electrode of the data writing transistor M3 and the gate electrode of the threshold compensation transistor M4 are electrically connected to the same signal line, such as the gate line G1, to receive the same signal (for example, the scan signal Vg1), at this time, the display panel comprising the pixel circuit 100 cannot be provided with the threshold compensation control line G2, thereby reducing the number of signal lines. For another example, the gate electrode of the data writing transistor M3 and the gate electrode of the threshold compensation transistor M4 can also be electrically connected to different signal lines, that is, the gate electrode of the data writing transistor M3 is electrically connected to the gate line G1, the gate electrode of the threshold compensation transistor M4 is electrically connected to the threshold compensation control line G2, and the gate line G1 and the threshold compensation control line G2 transmit the same signal.

It should be note that the threshold compensation control signal Vg2 and the scan signal Vg1 are also different, so that the data writing transistor M3 and the threshold compensation transistor M4 can be controlled separately, thereby increasing the flexibility of controlling the pixel circuit.

For example, as shown in FIG. 4, the pixel circuit 100 further comprises a reference voltage writing sub-circuit 17. The reference voltage writing sub-circuit 17 is configured to receive a reference voltage control signal VCR, and write the reference voltage to the first end (that is, the fourth node N4) of the second capacitor C2 according to the reference voltage control signal VCR.

For example, the reference voltage writing sub-circuit 17 can comprise a reference voltage writing transistor M5. A first electrode of the reference voltage writing transistor M5 is configured to receive a reference voltage Vref, a second electrode of the reference voltage writing transistor M5 is electrically connected to the first end of the second capacitor C2, and a gate electrode of the reference voltage writing transistor M5 is configured to receive the reference voltage control signal VCR. For example, the first electrode of the reference voltage writing transistor M5 can be electrically connected to a reference power terminal REF to receive the reference voltage Vref, and the gate electrode of the reference voltage writing transistor M5 can be electrically connected to a reference voltage control line CR to receive the reference voltage control signal VCR.

For example, in the data writing stage, the reference voltage control line CR can provide the reference voltage control signal VCR to the gate electrode of the reference voltage writing transistor M5 to turn on the reference voltage writing transistor M5. The reference power terminal REF can provide the reference voltage $V_{ref}$ to the first electrode of the reference voltage writing transistor M5, so that the reference voltage $V_{ref}$ charges the first end of the second capacitor C2 through the reference voltage writing transistor M5, and therefore, the voltage of the first end of the second capacitor C2 can be the reference voltage $V_{ref}$.

For example, the reference voltage control signal VCR and the light-emitting control signal VEM can be the same. For example, the gate electrode of the light-emitting control transistor M2 and the gate electrode of the reference voltage writing transistor M5 can be electrically connected to the same signal line, such as the light-emitting control line EM, to receive the same signal (for example, the light-emitting control signal VEM). At this time, the display panel comprising the pixel circuit 100 cannot be provided with the reference voltage control line CR, thereby reducing the number of signal lines.

It should be noted that, the reference voltage control signal VCR and the light-emitting control signal VEM may also be different, and the embodiments of the present disclosure do not limit this.

For example, as shown in FIG. 4, the pixel circuit 100 further comprises a first reset sub-circuit 18. The first reset sub-circuit 18 is configured to receive a first reset control signal and write a first reset voltage to the third node N3 (that is, the gate electrode of the driving transistor M1) according to the first reset control signal.

For example, the first reset sub-circuit 18 comprises a first reset transistor M6. A first electrode of the first reset transistor M6 is configured to receive a first reset voltage, a second electrode of the first reset transistor M6 is electrically connected to the third node N3, that is, the second electrode of the first reset transistor M6 is electrically connected to the gate electrode of the driving transistor M1, and a gate electrode of the first reset transistor M6 is configured to receive a first reset control signal Vrt1. For example, the first electrode of the first reset transistor M6 is electrically connected to a first reset power terminal VINT to receive the first reset voltage Vint1, and the gate electrode of the first reset transistor M6 is electrically connected to a first reset control signal line Rst1 to receive the first reset control signal Vrt1.

For example, the first reset power terminal VINT is a direct-current reference voltage terminal to output a constant direct-current reference voltage. The first reset power terminal VINT can be a high voltage terminal or a low voltage terminal, as long as the first reset power terminal VINT can provide the first reset voltage Vint1 to reset the third node N3, which is not limited in the present disclosure.

For example, as shown in FIG. 4, the pixel circuit 100 further comprises a second reset sub-circuit 19. The second reset sub-circuit 19 is configured to receive a second reset control signal and write a second reset voltage to the first end (that is, the fourth node N4) of the second capacitor C2 according to the second reset control signal.

For example, the second reset sub-circuit 19 comprises a second reset transistor M7. In the embodiment shown in FIG. 4, the first voltage output by the first power terminal VDD can be used as the second reset voltage Vint2, so that a first electrode of the second reset transistor M7 is electrically connected to the first power terminal VDD. A second electrode of the second reset transistor M7 is electrically connected to the first end of the second capacitor C2. A gate electrode of the second reset transistor M7 is configured to receive a second reset control signal Vrt2, for example, the gate electrode of the second reset transistor M7 is electrically connected to a second reset control signal line Rst2 to receive the second reset control signal Vrt2. However, the embodiments of the present disclosure are not limited thereto, and the first electrode of the second reset transistor M7 may also be electrically connected to a separately provided second reset power terminal to receive the second reset voltage Vint2.

For example, the first reset control signal Vrt1 and the second reset control signal Vrt2 can be the same, so that the gate electrode of the first reset transistor M6 and the gate electrode of the second reset transistor M7 can be electrically connected to the same signal line (for example, the first reset control signal line Rst1) to receive the same reset control signal (for example, the first reset control signal Vrt1). It should be noted that the first reset control signal Vrt1 and the second reset control signal Vrt2 may also be different.

For example, in some embodiments, the first reset voltage Vint1 and the second reset voltage Vint2 can be the same.

It should be noted that the second compensation sub-circuit, the reference voltage writing sub-circuit, the first reset sub-circuit, the second reset sub-circuit, the light-emitting control sub-circuit, the data writing sub-circuit, and the storage sub-circuit in the pixel circuit shown in FIG. 4 is only schematic. The specific structures of circuits such as the second compensation sub-circuit, the reference voltage writing sub-circuit, the first reset sub-circuit, the second reset sub-circuit, the light-emitting control sub-circuit, the data writing sub-circuit, and the storage sub-circuit can be set according to actual application requirements, and are not specifically limited in the embodiments of the present disclosure.

For example, according to the characteristics of transistors, transistors can be divided into N-type transistors and P-type transistors. For the sake of clarity, the embodiments of the present disclosure take the transistors as P-type transistors (for example, P-type MOS transistors) as an example to elaborate on the technical solutions of the present disclosure. However, the transistors in the embodiments of the present disclosure are not limited to P-type transistors, and those skilled in the art can also use N-type transistors (for example, N-type MOS transistors) to implement the functions of one or more transistors in the embodiments of the present disclosure according to actual needs.

It should be noted that the transistors used in the embodiments of the present disclosure may be thin film transistors or field effect transistors or other switching devices with the same characteristics. The thin film transistors may include oxide semiconductor thin film transistors, amorphous silicon thin film transistors, or polysilicon thin film transistors, etc. The source electrode and the drain electrode of the transistor can be symmetrical in structure, so the source electrode and the drain electrode can be indistinguishable in physical structure. In the embodiments of the present disclosure, in order to distinguish the transistor, except for the gate electrode of the transistor as the control electrode, one electrode is directly described as the first electrode and the other electrode is the second electrode, therefore, the first electrode and the second electrode of all or part of the transistors in the embodiments of the present disclosure can be interchanged as required.

Figure 5:
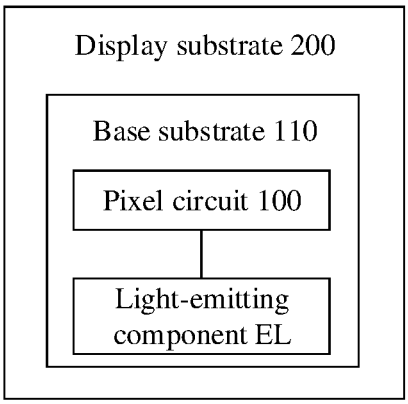
FIG. 5 is a schematic block diagram of a display substrate provided by some embodiments of the present disclosure.
Figure 6:
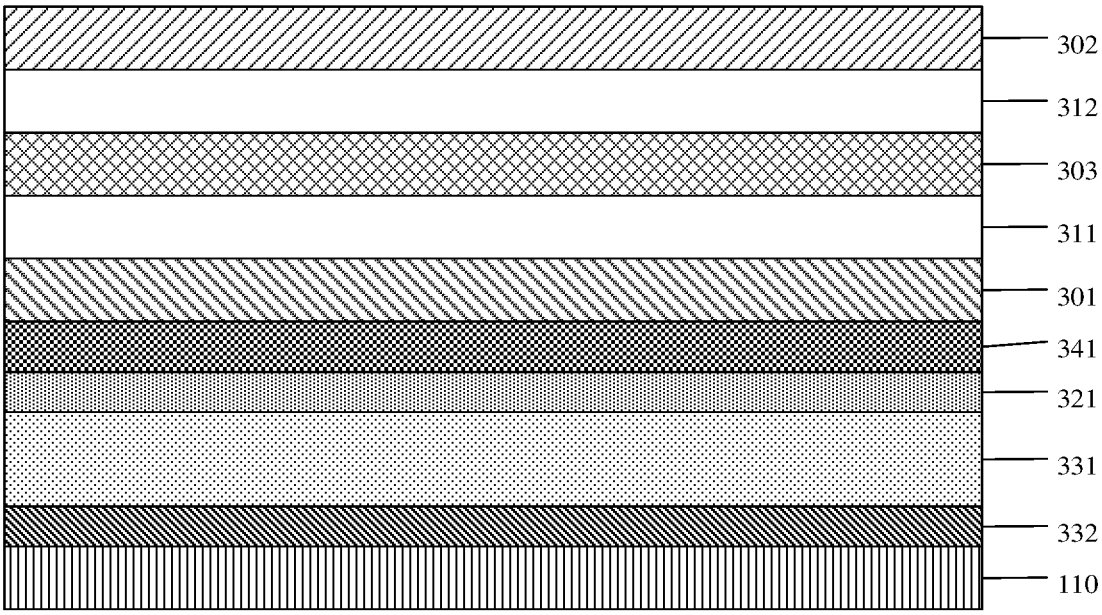
FIG. 6 is a schematic cross-sectional diagram of a first node in the pixel circuit shown in FIG. 4.

An embodiment of the present disclosure also provides a display substrate. FIG. 5 is a schematic block diagram of a display substrate provided by some embodiments of the present disclosure, and FIG. 6 is a schematic cross-sectional diagram of a first node in the pixel circuit shown in FIG. 4.

For example, as shown in FIG. 5, the display substrate 200 can comprise a base substrate 110, and a pixel circuit 100 and a light-emitting component EL according to any embodiment of the present disclosure. The light-emitting component EL and the pixel circuit 100 are both arranged on the base substrate 10.

For example, the display substrate 200 can be applied to an organic light-emitting diode display panel and the like. The display substrate 200 may be an array substrate.

For example, the base substrate 110 can be a suitable substrate such as a glass substrate or a quartz substrate.

For example, in some embodiments, in the case where the first compensation sub-circuit in the pixel circuit 100 comprises a first capacitor, taking the embodiment shown in FIG. 4 as an example, as shown in FIG. 6, the first capacitor C1 comprises a first electrode 321 and a second electrode, the first electrode 321 of the first capacitor C1 is the first end of the first capacitor C1, the second electrode of the first capacitor C1 is the second end of the first capacitor C1, that is, the first electrode 321 of the first capacitor C1 is electrically connected to the first node N1, that is, the first electrode 321 of the first capacitor C1 is electrically connected to the second electrode (for example, the drain electrode) of the driving transistor M1, the second electrode of the first capacitor C1 is electrically connected to the second node N2, that is, the second electrode of the first capacitor C1 is electrically connected to a first light-emitting voltage applying electrode of the light-emitting component EL.

For example, as shown in FIG. 6, there is a first intermediate layer 331 and a second intermediate layer 332 between the first capacitor C1 and the base substrate 110. The first intermediate layer 331 can comprise a gate insulating layer (GI layer), a gate layer (GATE layer), an interlayer dielectric layer (ILD), and the like of transistors (for example, the light-emitting control transistor, the driving transistor, etc.) in the pixel circuit. The second intermediate layer 332 may include an active semiconductor layer or the like of transistors (for example, the light-emitting control transistor, the driving transistor, etc.) in the pixel circuit. For example, the gate insulating layer and the interlayer dielectric layer are inorganic layers, and the gate layer and the like are metal layers.

For example, as shown in FIG. 6, the light-emitting component EL includes a first light-emitting voltage applying electrode 301, a second light-emitting voltage applying electrode 302, and a light-emitting layer 303 provided between the first light-emitting voltage applying electrode 301 and the second light-emitting voltage applying electrode 302.

For example, the material of the light-emitting layer 303 can be selected according to the color of light emitted by the light-emitting component EL. The material of the light-emitting layer 303 comprises a fluorescent light-emitting material or a phosphorescent light-emitting material. For example, the first light-emitting voltage applying electrode 301 is an anode, the second light-emitting voltage applying electrode 302 is a cathode, and both the first light-emitting voltage applying electrode 301 and the second light-emitting voltage applying electrode 302 are made of conductive materials.

For example, as shown in FIG. 6, a first organic layer 311 is provided between the first light-emitting voltage applying electrode 301 and the light-emitting layer 303, and a second organic layer 312 is provided between the second light-emitting voltage applying electrode 302 and the light-emitting layer 303. The first organic layer 311 and the second organic layer 312 play a role of planarization and may be omitted. It should be noted that in the embodiments of the present disclosure, the light-emitting layer of each light-emitting component may comprise the electroluminescent layer itself and other common layers located on both sides of the electroluminescent layer, for example, a hole injection layer, a hole transport layer, an electron injection layer, and an electron transport layer, etc., but in the drawings of the present disclosure, only the electroluminescent layer in the light-emitting layer is shown, and other common layers are not shown.

For example, an orthographic projection of the first light-emitting voltage applying electrode 301 on the base substrate 110, an orthographic projection of the light-emitting layer 303 on the base substrate 110, and an orthographic projection of the second light-emitting voltage applying electrode 302 on the base substrate 110 at least partially overlap. For example, the orthographic projection of the first light-emitting voltage applying electrode 301 on the base substrate 110 is located within the orthographic projection of the second light-emitting voltage applying electrode 302 on the base substrate 110, and the orthographic projection of the light-emitting layer 303 on the base substrate 110 is located within the orthographic projection of the second light-emitting voltage applying electrode 302 on the base substrate 110.

It should be noted that for each sub-pixel (for example, the first sub-pixel, the second sub-pixel, the third sub-pixel, or the fourth sub-pixel), in the region where the orthographic projection of the first light-emitting voltage applying electrode 301 on the base substrate 110, the orthographic projection of the light-emitting layer 303 on the base substrate 110, and the orthographic projection of the second light-emitting voltage applying electrode 302 on the base substrate 110 overlap, the portion corresponding to the opening of the pixel defining layer is used for light emission.

For example, in a direction perpendicular to the base substrate 110, the first electrode 321 of the first capacitor C1 is located between the first light-emitting voltage applying electrode 301 and the base substrate 110, the first light-emitting voltage applying electrode 301 is located between the first electrode 321 of the first capacitor C1 and the light-emitting layer 303.

For example, the second electrode of the first capacitor C1 and the first light-emitting voltage applying electrode 301 are integrally provided, that is, the second electrode of the first capacitor C1 and the first light-emitting voltage applying electrode 301 are the same electrode, the first light-emitting voltage applying electrode 301 is multiplexed as the second electrode of the first capacitor C1. Therefore, in the pixel circuit provided by the embodiments of the present disclosure, the first electrode 321 of the first capacitor C1 is formed only by adding a metal layer between the first light-emitting voltage applying electrode 301 and the first intermediate layer 331. The first electrode 321 of the first capacitor C1 and the first light-emitting voltage applying electrode 301 can form the first capacitor C1, thereby achieving compensation for the level of the second node, solving the problem of difference in pixel brightness of the display panel, and improving the display uniformity and the display effect. For example, the second electrode of the first capacitor C1 and the first light-emitting voltage applying electrode 301 may also be two separate electrodes, but the second electrode of the first capacitor C1 and the first light-emitting voltage applying electrode 301 are electrically connected to each other.

For example, an orthographic projection of the first electrode 321 (that is, the added metal layer) of the first capacitor C1 on the base substrate 110 and an orthographic projection of the first light-emitting voltage applying electrode 301 on the base substrate 110 at least partially overlap. For example, in some examples, the orthographic projection of the first electrode 321 of the first capacitor C1 on the base substrate 110 is located within the orthographic projection of the first light-emitting voltage applying electrode 301 on the base substrate 110, that is, the orthographic projection of the first light-emitting voltage applying electrode 301 on the base substrate 110 completely covers the orthographic projection of the first electrode 321 of the first capacitor C1 on the base substrate 110.

It should be noted that, as shown in FIG. 6, a dielectric layer 341 is further provided between the first light-emitting voltage applying electrode 301 and the first electrode 321, and the first light-emitting voltage applying electrode 301 and the first electrode 321 are not directly electrically connected.

It should be noted that other components of the display substrate 200 are understood by those of ordinary skill in the art, and will not be repeated here, nor should they be used as a limitation to the present disclosure.

Figure 7:
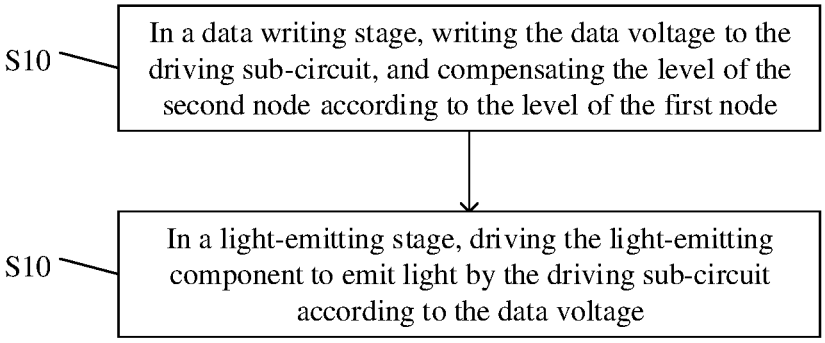
FIG. 7 is a schematic flow chart of a driving method of a pixel circuit provided by some embodiments of the present disclosure.

An embodiment of the present disclosure also provides a driving method of a pixel circuit, and the driving method can be applied to any of the above-mentioned pixel circuits. FIG. 7 is a schematic flow chart of a driving method of a pixel circuit provided by some embodiments of the present disclosure. As shown in FIG. 7, the driving method of the pixel circuit comprises the following steps:

S10: in a data writing stage, writing the data voltage to the driving sub-circuit, and compensating the level of the second node according to the level of the first node;

S20: in a light-emitting stage, driving the light-emitting component to emit light by the driving sub-circuit according to the data voltage.

For example, in some embodiments, in the case where the pixel circuit further comprises a first reset sub-circuit and a second reset sub-circuit, for example, in the embodiment shown in FIG. 4, the driving method of the pixel circuit further comprises: in a reset stage, resetting the third node by the first reset sub-circuit, and resetting the fourth node by the second reset sub-circuit.

For example, the timing chart of the pixel circuit can be set according to actual requirements, and is not specifically limited in the embodiments of the present disclosure.

Figure 8:
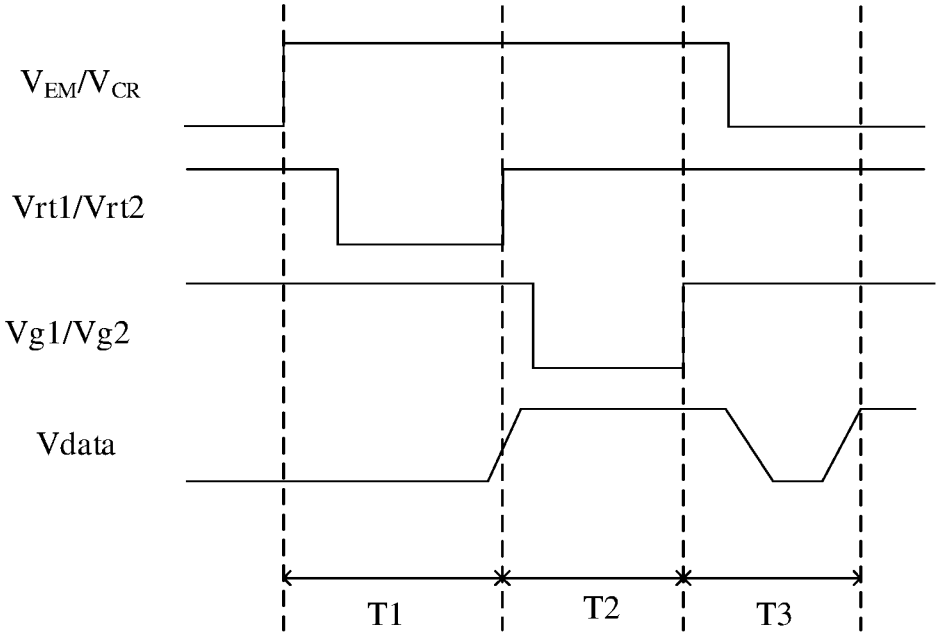
FIG. 8 is an exemplary timing chart of the driving method of a pixel circuit shown in FIG. 4.

For example, in some embodiments, FIG. 8 is an exemplary timing chart of the driving method of a pixel circuit shown in FIG. 4. The operation flow of a driving method of a pixel circuit provided by an embodiment of the present disclosure will be described in detail below with reference to FIG. 4 and FIG. 8. It should be noted that in the following description, the first reset control signal Vrt1 and the second reset control signal Vrt2 are the same, the threshold compensation control signal Vg2 is the same as the scan signal Vg1, and the reference voltage control signal VCR and the light-emitting control signal VEM are the same. All transistors in the pixel circuit are P-type transistors.

For example, as shown in FIG. 4 and FIG. 8, in the reset stage T1, the first reset control signal Vrt1 and the second reset control signal Vrt2 are both low-level signals (that is, turn-on signals, for example −6V), and the scan signal Vg1, the threshold compensation control signal Vg2, the reference voltage control signal VCR, and the light-emitting control signal VEM are all high-level signals (that is, turn-off signals, for example 6V), so that the first reset transistor M6 and the second reset transistor M7 are both turned on, and the light-emitting control transistor M2, the data writing transistor M3, the threshold compensation transistor M4, and the reference voltage writing transistor M5 are all turned off. The first reset voltage Vint1 output from the first reset power terminal VINT is written into the third node N3 (that is, the gate electrode of the driving transistor M1 and the second end of the second capacitor C2) via the first reset transistor M6 to reset the third node N3, and the second reset voltage Vint2 output from the first power terminal VDD is written into the fourth node N4 (that is, the first end of the second capacitor C2) via the second reset transistor M7 to reset the third node N4. Thus, in the previous frame, the voltage held on the gate electrode of the driving transistor M1 and the voltage on the first end of the second capacitor C2 are cleared, and the gate electrode of the driving transistor M1 and the first end of the second capacitor C2 are both reset. For example, at this time, the voltage on the third node N3 is the first reset voltage Vint1, the voltage on the fourth node N4 is the second reset voltage Vint2, the first reset voltage Vint1 and the second reset voltage Vint2 are the same, so that the voltage on the third node N3 and the voltage on the fourth node N4 are the same.

For example, as shown in FIG. 4 and FIG. 8, in the data writing stage T2, the first reset control signal Vrt1 and the second reset control signal Vrt2 become high-level signals, the scan signal Vg1 and the threshold compensation control signal Vg2 become low-level signals, and the reference voltage control signal VCR and the light-emitting control signal VEM are maintained as high-level signals. Thus, the data writing transistor M3 and the threshold compensation transistor M4 are all turned on, the first reset transistor M6, the second reset transistor M7, the light-emitting control transistor M2, and the reference voltage writing transistor M5 are all turned off. Because the data writing transistor M3 is turned on, the data voltage Vdata (for example, the range of the data voltage Vdata is 2.1V to 4.5V) is written into the fourth node N4 via the data writing transistor M3, so that the voltage on the fourth node N4 changes to the data voltage Vdata. Due to the bootstrap effect of the second capacitor C2, the voltage on the third node N3 also becomes the data voltage Vdata. In addition, the threshold compensation transistor M4 is turned on, the driving transistor M1 forms a diode connection, the driving transistor M1 is controlled to be turned on, and the threshold compensation transistor M4 is also turned on. The first voltage V1 output from the first power terminal VDD can charge the third node N3 via the driving transistor M1 and the threshold compensation transistor M4. In a case where the voltage of the third node N3 is V1+Vth, Vth is the threshold voltage of the driving transistor M1, a voltage difference VGS between the first electrode of the driving transistor M1 (the voltage of the first electrode of the driving transistor M1 is the first voltage V1) and the gate electrode of the driving transistor M1 is equal to the threshold voltage Vth of the driving transistor M1, that is, VGS=Vth, at this time, the driving transistor M1 is turned off, and the threshold compensation ends.

It should be noted that the threshold compensation voltage can be V1+Vth.

For example, in the data writing stage T2, because the threshold compensation transistor M4 is turned on, the voltage of the first node N1 and the voltage of the third node N3 are the same, so that the change process of the voltage of the first node N1 is the same as the change process of the voltage of the third node N3. Due to the bootstrap effect of the first capacitor C1, when the voltage of the first node N1 changes, the voltage of the second node N2 can be controlled to change accordingly, thereby achieving the compensation for the second node N2. For example, if the voltage of the first node N1 gradually increases, the voltage of the second node N2 also gradually increases.

For example, as shown in FIG. 4 and FIG. 8, in the light-emitting stage T3, the first reset control signal Vrt1 and the second reset control signal Vrt2 are maintained as high-level signals, the scan signal Vg1 and the threshold compensation control signal Vg2 becomes high-level signals, and the reference voltage control signal VCR and the light-emitting control signal VEM become low-level signals. Thus, the light-emitting control transistor M2 and the reference voltage writing transistor M5 are both turned on, the data writing transistor M3, the threshold compensation transistor M4, the first reset transistor M6, and the second reset transistor M7 are all turned off. Because the reference voltage writing transistor M5 is turned on, the reference voltage $V_{ref}$ is written to the fourth node N4 via the reference voltage writing transistor M5, so that the voltage on the fourth node N4 becomes the reference voltage $V_{ref}$, that is, the voltage on the fourth node N4 changes from the data voltage Vdata to the reference voltage $V_{ref}$. Due to the bootstrap effect of the second capacitor C2, the voltage on the third node N3 becomes $V_{ref}$−Vdata+V1+Vth, that is, the voltage on the gate electrode of the driving transistor M1 is $V_{ref}$−Vdata+V1+Vth, and the voltage on the first electrode of the driving transistor M1 is the first voltage V1. It should be noted that in step S12, "the driving sub-circuit drives the light-emitting component to emit light based on the data voltage" means that the driving sub-circuit is turned on under the control of the voltage $V_{ref}$−Vdata+V1+Vth, thereby driving the light-emitting component to emit light.

For example, in the light-emitting stage T3, the driving transistor M1 is in a saturation state. According to the saturation current formula of the driving transistor M1, the light-emitting current $I_{EL}$ flowing through the driving transistor M1 can be expressed as:

$$I_{EL} = K^*(VGS - Vth)^2 = K^*[(V_{ref} - Vdata + V1 + Vth - V1) - Vth]^2 = K^*(V_{ref} - Vdata)^2$$

It can be seen from the above formula that the light-emitting current $I_{EL}$ is not affected by the threshold voltage Vth of the driving transistor M1 and the first voltage output from the first power terminal VDD, but is only related to the reference voltage $V_{ref}$ output from the reference power terminal REF and the data voltage Vdata. The data voltage Vdata is directly transmitted by the data line and has nothing to do with the threshold voltage Vth of the driving transistor M1, so that the problem of the threshold voltage drift of the driving transistor M1 caused by the technological process and long-term operation can be solved. The reference voltage $V_{ref}$ is provided by the reference power terminal REF, and has nothing to do with the power voltage drop (IR drop) of the first power terminal VDD, so that the IR drop problem of the display panel can be solved. In summary, the pixel circuit can ensure the accuracy of the light-emitting current $I_{EL}$, eliminate the influence of the threshold voltage of the driving transistor M1 and the IR drop on the light-emitting current $I_{EL}$, and ensure the normal operation of the light-emitting component EL. In addition, in the pixel circuit, the first capacitor C1 is added between the first node N1 and the second node N2 to compensate the level of the second node N2 based on the level of the first node N1, and therefore, the problem of the difference in pixel brightness of the display panel can be solved, and the uniformity of the display screen can be improved, and the display effect can be improved.

For example, in the above formula, K is a constant, and K can be expressed as:

$$K=0.5^*\mu_n^*C_{ox}^*(W/L)$$

where $\mu_n$ is the electron mobility of the driving transistor M1, $C_{ox}$ is the unit capacitance of the gate electrode of the driving transistor M1, W is the channel width of the driving transistor M1, and L is the channel length of the driving transistor M1.

It should be noted that the setting modes of the reset stage, the data writing stage, and the light-emitting stage can be set according to actual application requirements, and the embodiments of the present disclosure do not specifically limit this.

Figure 9:
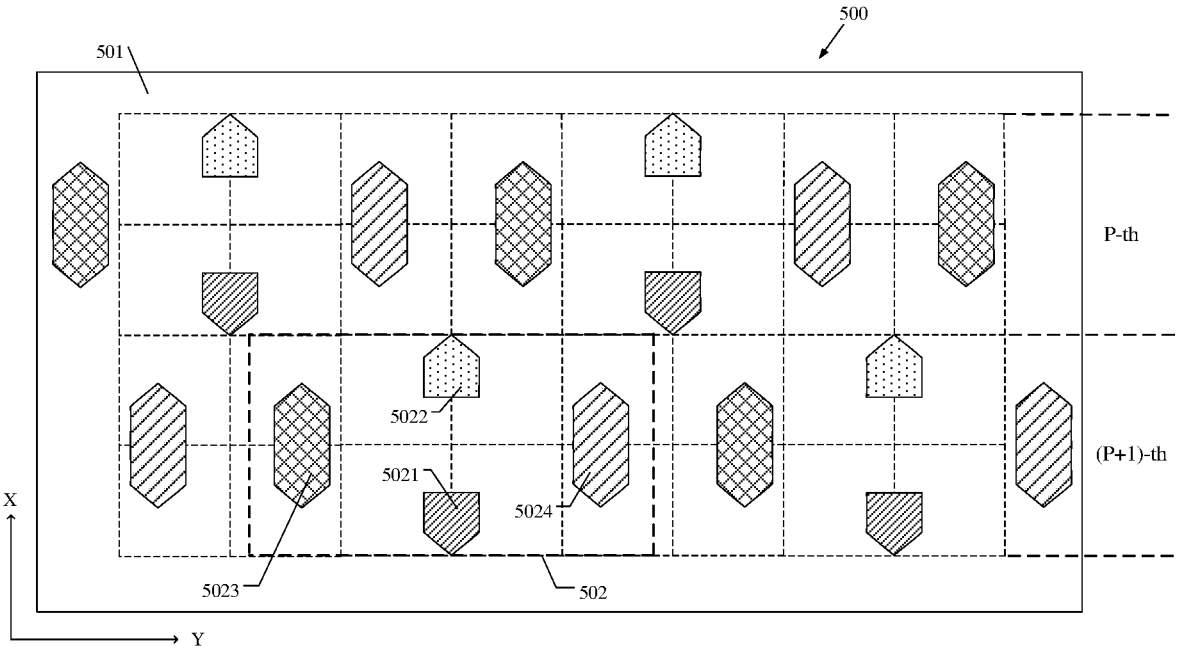
FIG. 9 is a schematic diagram of a partial structure of a display panel provided by some embodiments of the present disclosure.

An embodiment of the present disclosure also provides a display panel. FIG. 9 is a schematic diagram of a partial structure of a display panel provided by some embodiments of the present disclosure.

For example, as shown in FIG. 9, a display panel 500 provided by an embodiment of the present disclosure comprises a base substrate 501 and a plurality of repeating units 502 located on the base substrate 501. Each repeating unit 502 comprises a first sub-pixel 5021, a second sub-pixel 5022, a third sub-pixel 5023, and a fourth sub-pixel 5024. The first sub-pixel 5021 comprises a first light-emitting component and a first pixel circuit, the first pixel circuit is a pixel circuit according to any one of the above embodiments. The first light-emitting component is a light-emitting component driven by the first pixel circuit, in another words, the first pixel circuit may be the pixel circuit 100 shown in FIG. 4, and the first light-emitting component may be the light-emitting component EL shown in FIG. 4.

It should be noted that the positional relationship between the first sub-pixel 5021 and the second sub-pixel 5022 shown in FIG. 9 is only illustrative, and the present disclosure does not limit the relative positional relationship between the first sub-pixel 5021 and the second sub-pixel 5022. But in the embodiments of the present disclosure, an orthographic projection of the gate electrode of the driving transistor in the first pixel circuit of the first sub-pixel 5021 on the base substrate and the orthographic projection of the anode of the first light-emitting component of the first sub-pixel 5021 on the base substrate at least partially overlap, while the orthographic projection of the gate electrode of the driving transistor in the second pixel circuit of the second sub-pixel 5022 on the base substrate and the orthographic projection of the anode of the second light-emitting component of the second sub-pixel 5022 on the base substrate do not overlap. In addition, FIG. 9 only shows the shapes of, for example, the anodes of respective sub-pixels.

Figure 10:
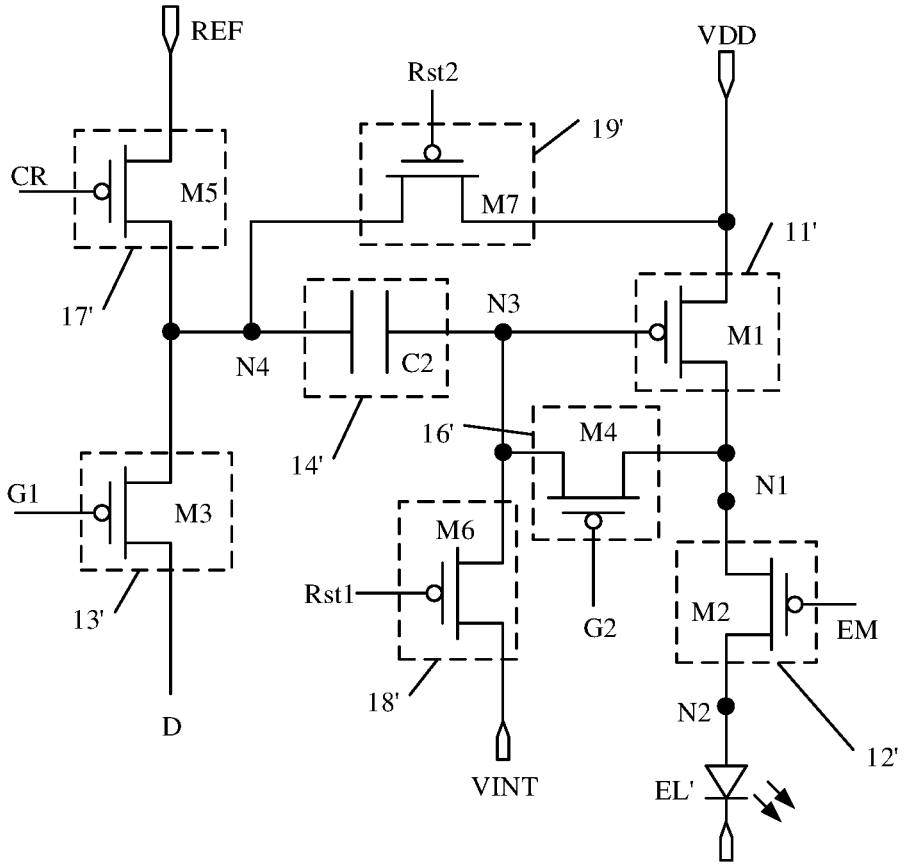
FIG. 10 is a schematic structural diagram of a second pixel circuit provided by some embodiments of the present disclosure.

FIG. 10 is a schematic structural diagram of a second pixel circuit provided by some embodiments of the present disclosure. For example, as shown in FIG. 10, the second sub-pixel 5022 comprises a second light-emitting component EL' and a second pixel circuit, the second pixel circuit is configured to drive the second light-emitting component EL' to emit. Compared with the first pixel circuit, the second pixel circuit does not comprise the first capacitor provided between the first node N1 and the second node N2, except this, the remaining components in the second pixel circuit are the same as the remaining components in the first pixel circuit. That is, as shown in FIG. 10, the second pixel circuit can comprise a driving sub-circuit 11', a light-emitting control sub-circuit 12', a data writing sub-circuit 13', a storage sub-circuit 14', a second compensation sub-circuit 16', a reference voltage writing sub-circuit 17', a first reset sub-circuit 18', and a second reset sub-circuit 19', and so on, and the connection mode of the respective sub-circuits is the same as the connection mode of the corresponding respective sub-circuits in the first pixel circuit.

Figure 11:
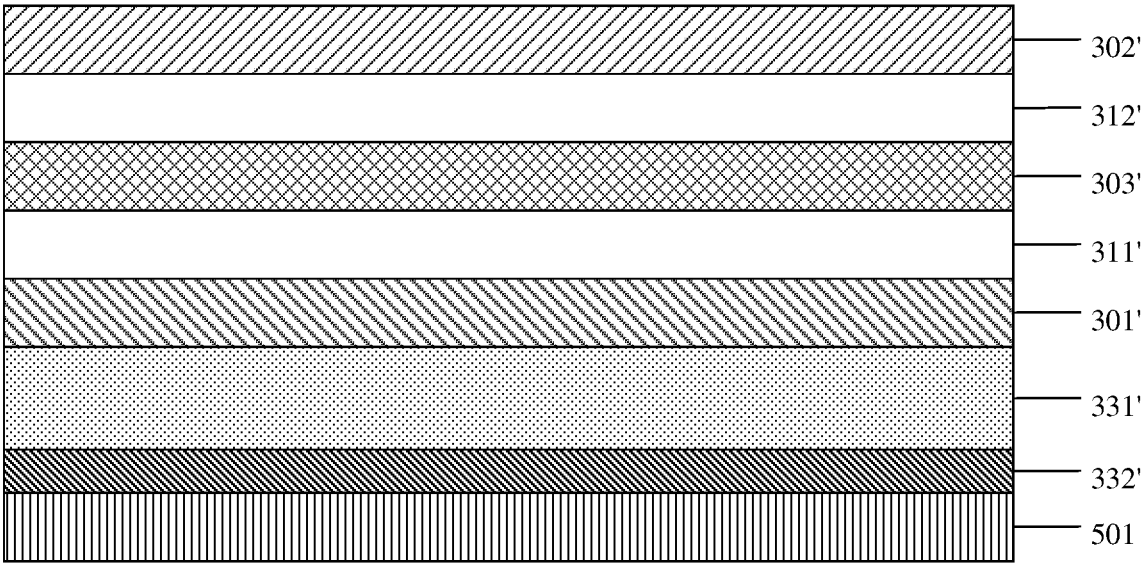
FIG. 11 is a schematic cross-sectional diagram of a first node in the second pixel circuit shown in FIG. 10.

FIG. 11 is a schematic cross-sectional diagram of a first node in the second pixel circuit as shown in FIG. 10. As shown in FIG. 11, the second light-emitting component EL' comprises a first light-emitting voltage applying electrode 301', a second light-emitting voltage applying electrode 302', and a light-emitting layer 303' that is located between the first light-emitting voltage applying electrode 301' and the second light-emitting voltage applying electrode 302'. A first organic layer 311' is provided between the first light-emitting voltage applying electrode 301' and the light-emitting layer 303', and a second organic layer 312' is provided between the second light-emitting voltage applying electrode 302' and the light-emitting layer 303'. A first intermediate layer 331' and a second intermediate layer 332' are also provided between the first light-emitting voltage applying electrode 301' and the base substrate 501. Compared with the first pixel circuit, no metal layer is provided at the first node of the second pixel circuit, that is, no capacitor is provided between the first node and the second node.

For example, in a direction perpendicular to the base substrate 501, the driving sub-circuit in the first pixel circuit is located between the first light-emitting component and the base substrate 501, and the driving sub-circuit in the second pixel circuit is located between the second light-emitting component and the base substrate 501. An orthographic projection of the driving sub-circuit in the first pixel circuit on the base substrate 501 and an orthographic projection of the first light-emitting component on the base substrate 501 at least partially overlap. For example, the orthographic projection of the driving sub-circuit in the first pixel circuit on the base substrate 501 is located within the orthographic projection of the first light-emitting component on the base substrate 501. For example, the orthographic projection of the driving sub-circuit in the first pixel circuit on the base substrate 501 completely overlaps with the orthographic projection of the first light-emitting component on the base substrate 501. An orthographic projection of the driving sub-circuit in the second pixel circuit on the base substrate 501 and an orthographic projection of the second light-emitting component on the base substrate 501 at least partially do not overlap. For example, the orthographic projection of the driving sub-circuit in the second pixel circuit on the base substrate 501 and the orthographic projection of the second light-emitting component on the base substrate 501 do not overlap at all. For example, the orthographic projection of the gate electrode of the driving transistor in the first sub-pixel 5021 on the base substrate 501 overlaps the orthographic projection of the anode of the first light-emitting component on the base substrate 501, but the orthographic projection of the gate electrode of the driving transistor in the second sub-pixel 5022 on the base substrate 501 and the orthographic projection of the anode of the second light-emitting component on the base substrate 501 do not overlap.

If an existing pixel circuit is used to drive the first light-emitting component and the second light-emitting component, that is, in a case where both the first pixel circuit and the second pixel circuit are the pixel circuits shown in FIG. 10, because the orthographic projection of the driving sub-circuit in the first sub-pixel 5021 on the base substrate 501 overlaps the orthographic projection of the anode of the first light-emitting component on the base substrate 501, and the orthographic projection of the driving sub-circuit in the second sub-pixel 5022 on the base substrate 501 do not overlap the orthographic projection of the anode of the second light-emitting component on the base substrate 501, so that the voltage of the gate electrode of the driving transistor in the second pixel circuit of the second sub-pixel is smaller than the voltage of the gate electrode of the driving transistor in the first pixel circuit of the first sub-pixel 5021, and therefore, the light-emitting current flowing through the driving transistor in the second pixel circuit of the second sub-pixel 5022 is greater than the light-emitting current flowing through the driving transistor in the first pixel circuit of the first sub-pixel 5021, the brightness of the second light-emitting component is higher than the brightness of the first light-emitting component, thereby causing the brightness of the first sub-pixel and the brightness of the second sub-pixel to be inconsistent.

Figure 12:
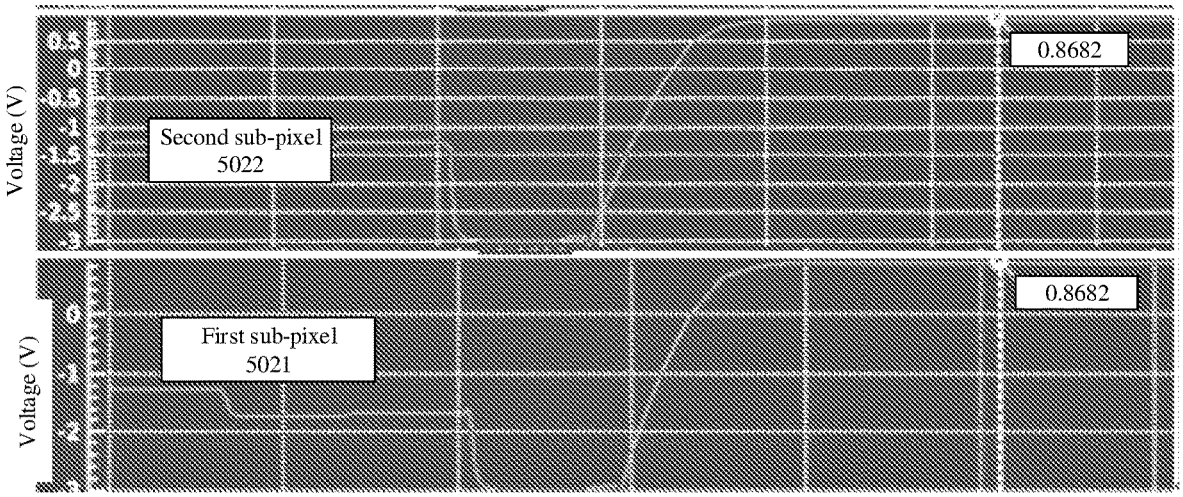
FIG. 12 is a schematic diagram of a detection result of an anode voltage of the first sub-pixel and a detection result of an anode voltage of the second sub-pixel in a repeating unit shown in FIG. 9.

FIG. 12 is a schematic diagram of a detection result of an anode voltage of the first sub-pixel and a detection result of an anode voltage of the second sub-pixel in a pixel repeating unit shown in FIG. 9.

If the pixel circuit provided by the embodiment of the present disclosure is used as the first pixel circuit in the first sub-pixel, the first compensation sub-circuit in the first pixel circuit (that is, the first capacitor C1 shown in FIG. 4) can compensate the level of the second node to improve the brightness of the first light-emitting component, and make the brightness of the first light-emitting component and the brightness of the second light-emitting component consistent. For example, the capacitance value of the first capacitor C1 in the first pixel circuit may range from 1 fF to 8 fF, but the present disclosure is not limited to this, as long as the first capacitor C1 can make the voltage of the second node in the first pixel circuit of the first sub-pixel match to the voltage of the second node in the second pixel circuit of the second sub-pixel, for example, the voltage of the second node in the first pixel circuit may be approximately equal to the voltage of the second node in the second pixel circuit. As shown in FIG. 12, a simulation analysis is performed on the first sub-pixel 5021 and the second sub-pixel 5022 in a repeating unit shown in FIG. 9, according to the simulation result of the simulation analysis, the anode voltage of the first sub-pixel 5021 is 0.8682 volts (V), and the anode voltage of the second sub-pixel 5022 is 0.8682 V, that is, the anode voltage of the first sub-pixel 5021 is equal to the anode voltage of the second sub-pixel 5022, the brightness of the first sub-pixel 5021 and the brightness of the second sub-pixel 5022 are the same, thereby improving the brightness uniformity of the display panel.

For example, the third sub-pixel 5023 may comprise a third light-emitting component and a third pixel circuit, and the third pixel circuit is configured to drive the third light-emitting component to emit light. The fourth sub-pixel 5024 may comprise a fourth light-emitting component and a fourth pixel circuit, and the fourth pixel circuit is configured to drive the fourth light-emitting component to emit light. Both the third pixel circuit and the fourth pixel circuit may be the same as the second pixel circuit shown in FIG. 10.

For example, the first sub-pixel 5021 and the second sub-pixel 5022 are both green sub-pixels, the third sub-pixel 5023 is a red sub-pixel, and the fourth sub-pixel 5024 is a blue sub-pixel. That is, the first light-emitting component and the second light-emitting component are configured to emit green light, the third light-emitting component is configured to emit red light, and the fourth light-emitting component is configured to emit blue light.

For example, the orthographic projection of the light-emitting layer of the light-emitting component (that is, the first light-emitting component) of the first sub-pixel 5021 on the base substrate 110 and the orthographic projection of the light-emitting layer of the light-emitting component (that is, the second light-emitting component) of the second sub-pixel 5022 on the base substrate 110 are continuous, that is, the light-emitting layer of the light-emitting component of the first sub-pixel and the light-emitting layer of the light-emitting component of the second sub-pixel can be made by one opening in the high-definition metal mask (FMM) plate, which can effectively reduce the process difficulty of the FMM. For example, the light-emitting layer of the light-emitting component of the first sub-pixel 5021 and the light-emitting layer of the light-emitting component of the second sub-pixel 5022 are integrated, that is, the light-emitting layer of the light-emitting component of the first sub-pixel 5021 and the light-emitting layer of the light-emitting component of the second sub-pixel 5022 are integrally provided. For the first sub-pixel 5021 and the second sub-pixel 5022, the portion where the integrated light-emitting layer overlaps the first light-emitting voltage applying electrode of the light-emitting component of the first sub-pixel 5021 can be represented as the light-emitting layer of the light-emitting component of the first sub-pixel 5021, the portion where the integrated light-emitting layer overlaps the first light-emitting voltage applying electrode of the light-emitting component of the second sub-pixel 5022 may be represented as the light-emitting layer of the light-emitting component of the second sub-pixel 5022.

For example, the display panel 500 further comprises a pixel defining layer (not shown), which is located on a side of the first light-emitting voltage applying electrode of the light-emitting component of each sub-pixel away from the base substrate 110 and comprises a first opening. The first opening exposes at least a part of the first light-emitting voltage applying electrode of the light-emitting component of the first sub-pixel 5021 and at least a part of the first light-emitting voltage applying electrode of the light-emitting component of the second sub-pixel 5022. At least part of the light-emitting layer of the light-emitting component of the first sub-pixel 5021 and at least part of the light-emitting layer of the light-emitting component of the second sub-pixel 5022 are located in the first opening and cover the exposed part of the first light-emitting voltage applying electrode of the first sub-pixel 5021 and the exposed part of the first light-emitting voltage applying electrode of the second sub-pixel 5022. The part region where the first opening overlaps with the first light-emitting voltage applying electrode of the first sub-pixel 5021 is an effective light-emitting region of the first sub-pixel 5021, and the part region where the first opening overlaps with the first light-emitting voltage applying electrode of the second sub-pixel 5022 is an effective light-emitting region of the second sub-pixel 5022. For example, the pixel defining layer also comprises a second opening, the second opening exposes a part of the first light-emitting voltage applying electrode of the light-emitting component of the third sub-pixel 5023, and at least part of the light-emitting layer of the light-emitting component of the third sub-pixel 5023 is located in the second opening and covers the exposed part of the first light-emitting voltage applying electrode of the third sub-pixel 5023, and the part region where the second opening overlaps with the first light-emitting voltage applying electrode of the third sub-pixel 5023 is an effective light-emitting region of the third sub-pixel 5023. The pixel defining layer further includes a third opening, the third opening exposes a part of the first light-emitting voltage applying electrode of the light-emitting component of the fourth sub-pixel 5024, and at least part of the light-emitting layer of the light-emitting component of the fourth sub-pixel 5024 is located in the third opening and covers the exposed part of the first light-emitting voltage applying electrode of the fourth sub-pixel 5024, and the part region where the third opening overlaps with the first light-emitting voltage applying electrode of the fourth sub-pixel 5024 is an effective light-emitting region of the fourth sub-pixel 5024.

For example, in some embodiments, the second light-emitting voltage applying electrodes of the light-emitting components of all sub-pixels on the display panel are integrally arranged, that is, the entire layer of the second light-emitting voltage applying electrode covers the entire base substrate 110, that is, the second light-emitting voltage applying electrode may be a planar electrode. For example, for the first sub-pixel 5021 and the second sub-pixel 5022, the portion where the planar second light-emitting voltage applying electrode overlaps with the first light-emitting voltage applying electrode of the light-emitting component of the first sub-pixel 5021 can be represented as the second light-emitting voltage applying electrode of the light-emitting voltage of the first sub-pixel 5021, and the portion where the planar second light-emitting voltage applying electrode overlaps with the first light-emitting voltage applying electrode of the light-emitting component of the second sub-pixel 5022 can be represented as the second light-emitting voltage applying electrode of the light-emitting voltage of the second sub-pixel 5022. That is, the second light-emitting voltage applying electrode of the light-emitting component of the first sub-pixel 5021 and the second light-emitting voltage applying electrode of the light-emitting component of the second sub-pixel 5022 are integrally provided.

For example, as shown in FIG. 9, in each repeating unit 502, the first sub-pixel 5021 and the second sub-pixel 5022 are arranged along the first direction X, and the third sub-pixel 5023 and the fourth sub-pixel 5024 are arranged along the second direction Y, the first direction X and the second direction Y are respectively two directions perpendicular to each other in the same plane (for example, a plane parallel to the surface of the base substrate 501).

For example, in each repeating unit 502, the line connecting the center of the first sub-pixel 5021 and the center of the second sub-pixel 5022 is the first center line, and the line connecting the center of the third sub-pixel 5023 and the center of the fourth sub-pixel 5024 is the second center line. The length of the first center line is shorter than the length of the second center line. For example, the first center line and the second center line are perpendicular to each other and bisect each other, and the first center line is parallel to the first direction X, and the second center line is parallel to the second direction Y.

For example, as shown in FIG. 9, a plurality of repeating units 502 are arranged along the second direction Y to form a plurality of repeating unit groups, FIG. 9 shows two repeating unit groups, and the two repeating unit groups are a P-th repeating unit group and a (P+1)-th repeating unit group, respectively. The P-th repeating unit group and the (P+1)-th repeating unit group are two adjacent repeating unit groups, for example, P is a positive integer greater than or equal to 1. The plurality of repeating unit groups are arranged along the first direction X. That is, the plurality of repeating units 502 are arranged in an array along the first direction X and the second direction Y.

For example, the extension line of the line connecting the center of the first sub-pixel and the center of the second sub-pixel of the repeating unit in the P-th repeating unit group and the extension line of the line connecting the center of the first sub-pixel and the center of the second sub-pixel of the (P+1)-th repeating unit group are not overlap. For example, the extension line of the line connecting the center of the first sub-pixel and the center of the second sub-pixel of the repeating unit in the P-th repeating unit group passes through the center of a gap between two adjacent repeating units in the (P+1)-th repeating unit group. Similarly, the extension line of the line connecting the center of the first sub-pixel and the center of the second sub-pixel of the repeating unit in the (P+1)-th repeating unit group passes through the center of a gap between two adjacent repeating units in the P-th repeating unit group.

Figure 13:
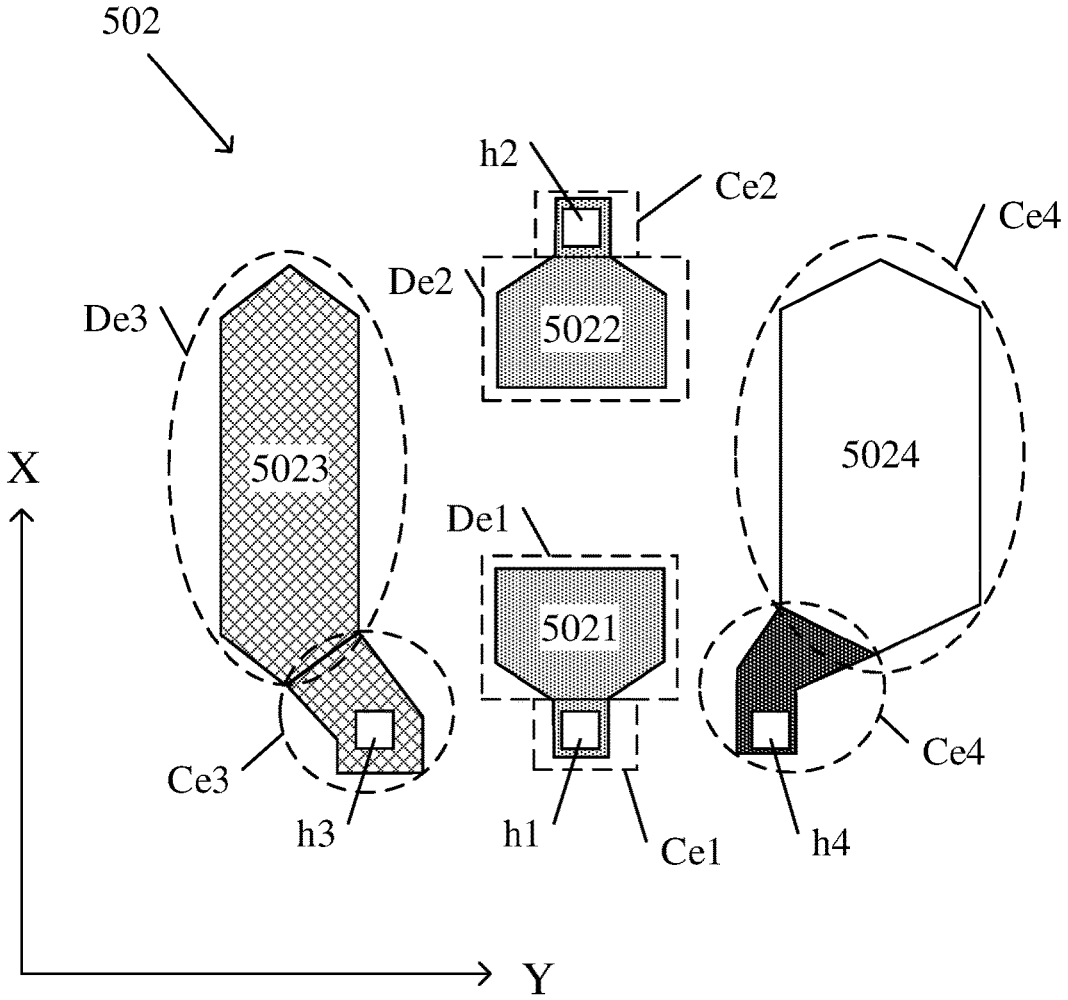
FIG. 13 is a schematic diagram of a repeating unit in a display panel provided by some embodiments of the present disclosure.

FIG. 13 is a schematic diagram of a repeating unit in a display panel provided by some embodiments of the present disclosure.

For example, as shown in FIG. 13, the first light-emitting voltage applying electrode of the first light-emitting component of the first sub-pixel 5021 comprises a first driving electrode block De1 and a first connection electrode block Ce1, and the first driving electrode block De1 and the first connection electrode block Ce1 are electrically connected. In each repeating unit 502, in the first direction X, the first connection electrode block Ce1 is located on the side of the first driving electrode block De1 away from the second light-emitting component of the second sub-pixel 5022.

For example, the first connection electrode block Ce1 is used to connect the first driving electrode block De1 and the first pixel circuit of the first sub-pixel 5021.

For example, in some embodiments, the first connection electrode block Ce1 and the first driving electrode block De1 are integrally provided. It should be noted that in other examples, the first connection electrode block Ce1 and the first driving electrode block De1 can also be separately provided, as long as the first connection electrode block Ce1 and the first driving electrode block De1 can be electrically connected to each other.

For example, as shown in FIG. 13, the first light-emitting voltage applying electrode of the second light-emitting component of the second sub-pixel 5022 comprises a second driving electrode block De2 and a second connection electrode block Ce2, and the second driving electrode block De2 and the second connection electrode block Ce2 are electrically connected. In each repeating unit 502, in the first direction X, the second connection electrode block Ce2 is located on the side of the second driving electrode block De2 away from the first light-emitting component of the first sub-pixel 5021.

For example, the second connection electrode block Ce2 is used to connect the second driving electrode block De2 and the second pixel circuit of the second sub-pixel 5022.

For example, in some embodiments, the second connection electrode block Ce2 and the second driving electrode block De2 are integrally provided. It should be noted that, in other examples, the second connection electrode block Ce2 and the second driving electrode block De2 can also be separately provided, as long as the second connection electrode block Ce2 and the second driving electrode block De2 can be electrically connected to each other.

For example, in the first direction X, the first driving electrode block De1 is located between the first connection electrode block Ce1 and the second driving electrode block De2, and the second driving electrode block De2 is located between the second connection electrode block Ce2 and the first driving electrode block De1.

For example, the line between the center of the first driving electrode block De1 and the center of the second driving electrode block De2 is parallel to the first direction X.

For example, the shape of the first driving electrode block De1 and the shape of the second driving electrode block De2 may be the same, and the area of the orthographic projection of the first driving electrode block De1 on the base substrate 110 is the same as the area of the orthographic projection of the second driving electrode block De2 on the base substrate 110. The shape of the first connection electrode block Ce1 and the shape of the second connection electrode block Ce2 may also be the same. The area of the orthographic projection of the first connection electrode block Ce1 on the base substrate 110 is the same as the area of the orthographic projection of the second connection electrode block Ce2 on the base substrate 110. For example, the shape of the first driving electrode block De1 and the shape of the second driving electrode block De2 may both be rectangular, pentagonal, or rhombic. The shape of the first connection electrode block Ce1 and the shape of the second connection electrode block Ce2 may be regular shapes, for example, a rectangle, a rhombus, etc.; the shape of the first connection electrode block Ce1 and the shape of the second connection electrode block Ce2 may also be irregular shapes.

It should be noted that, in some embodiments, the shape of the first driving electrode block De1 and the shape of the second driving electrode block De2 may also be rectangular or rhombic. The shape of the first driving electrode block De1 and the shape of the second driving electrode block De2 may also be different, and the present disclosure does not limit this.

For example, in the second direction Y, the width of the first connection electrode block Ce1 is smaller than the maximum width of the first driving electrode block De1, and the width of the second connection electrode block Ce2 is smaller than the maximum width of the second driving electrode block De2.

For example, as shown in FIG. 13, the first light-emitting voltage applying electrode of the third light-emitting component of the third sub-pixel 5023 comprises a third driving electrode block De3 and a third connection electrode block Ce3, and the third driving electrode block De3 and the third connection electrode block Ce3 can be electrically connected. In each repeating unit 502, in the first direction X, the third connection electrode block Ce3 is located on the side of the third driving electrode block De3 away from the second connection electrode block Ce2 of the second sub-pixel 5022, in the second direction Y, the third connection electrode block Ce3 is located on the side of the third driving electrode block De3 close to the fourth driving electrode block De4, that is, in the example shown in FIG. 13, the third connection electrode block Ce3 is located on the lower left side of the third driving electrode block De3. That is, the shape of the first light-emitting voltage applying electrode of the third light-emitting component of the third sub-pixel 5023 may be similar to a Q-shaped.

For example, the third connection electrode block Ce3 is used to connect the third driving electrode block De3 and the third pixel circuit of the third sub-pixel 5023.

It should be noted that, in some embodiments, the third driving electrode block De3 and the third connection electrode block Ce3 are integrally provided. It should be noted that, in other examples, the third driving electrode block De3 and the third connection electrode block Ce3 can also be separately provided, as long as the third driving electrode block De3 and the third connection electrode block Ce3 can be electrically connected to each other.

For example, as shown in FIG. 13, the first light-emitting voltage applying electrode of the fourth light-emitting component of the fourth sub-pixel 5024 comprises a fourth driving electrode block De4 and a fourth connection electrode block Ce4, and the fourth driving electrode block De4 and the fourth connection electrode block Ce4 are electrically connected. For example, as shown in FIG. 13, in each repeating unit 502, in the first direction X, the fourth connection electrode block Ce4 is located on the side of the fourth driving electrode block De4 away from the second connection electrode block Ce2 of the second sub-pixel 5022, in the second direction Y, the fourth connection electrode block Ce4 is located on the side of the fourth driving electrode block De4 close to the third driving electrode block De3, that is, in the example shown in FIG. 13, the fourth connection electrode block Ce4 is located on the lower right side of the fourth driving electrode block De4. That is, the shape of the first light-emitting voltage applying electrode of the fourth light-emitting component of the fourth sub-pixel 5024 may be similar to a Q-shaped mirror-symmetrical shape.

For example, the fourth connection electrode block Ce4 is used to connect the fourth driving electrode block De4 and the fourth pixel circuit of the fourth sub-pixel 5024.

For example, in some embodiments, the fourth connection electrode block Ce4 and the fourth driving electrode block De4 are integrally provided. It should be noted that in other examples, the fourth connection electrode block Ce4 and the fourth driving electrode block De4 may also be separately provided, as long as the fourth connection electrode block Ce4 and the fourth driving electrode block De4 can be electrically connected to each other.

For example, the line between the center of the third driving electrode block De3 and the center of the fourth driving electrode block De4 is parallel to the second direction Y.

For example, the shape of the third driving electrode block De3 and the shape of the fourth driving electrode block De4 may be the same, and the area of the orthographic projection of the third driving electrode block De3 on the base substrate 110 is different from the area of the orthographic projection of the fourth driving electrode block De4 on the base substrate 110. For example, the shape of the third driving electrode block De3 and the shape of the fourth driving electrode block De4 may both be rectangular, hexagonal, or long oval, etc. The area of the third driving electrode block De3 is smaller than the area of the fourth driving electrode block De4.

For example, the shape and area of the third connection electrode block Ce3 may be different from the shape and area of the fourth connection electrode block Ce4. For example, the shape of the third connection electrode block Ce3 and the shape of the fourth connection electrode block Ce4 may be regular shapes, such as rectangles, diamonds, etc.; the shape of the third connection electrode block Ce3 and the shape of the fourth connection electrode block Ce4 may also be irregular shapes. For example, in the example shown in FIG. 13, the shape of the third connection electrode block Ce3 and the shape of the fourth connection electrode block Ce4 are irregular hexagons.

For example, in the first direction X, the first connection electrode block Ce1, the second connection electrode block Ce2, the third connection electrode block Ce3, and the fourth connection electrode block Ce4 are located between two adjacent repeating unit groups. For example, in some embodiments, for the repeating unit 502 located in the (P+1)-th repeating unit group, the first connection electrode block Ce1, the third connection electrode block Ce3, and the fourth connection electrode block Ce4 are located between the (P+1)-th repeating unit group and the next adjacent repeating unit group (that is, a (P+2)-th repeating unit group), the second connection electrode block Ce2 is located between the P-th repeating unit group and the (P+1)-th repeating unit group.

For example, the orthographic projection of the first driving electrode block De1 on the base substrate 501 and the orthographic projection of the gate electrode of the driving transistor of the first pixel circuit on the base substrate 501 at least partially overlap. The orthographic projection of the second driving electrode block De2 on the base substrate 501 and the orthographic projection of the gate electrode of the driving transistor of the second pixel circuit on the base substrate 501 do not overlap at all. The orthographic projection of the third driving electrode block De3 on the base substrate 501 and the orthographic projection of the gate electrode of the driving transistor of the third pixel circuit on the base substrate 501 at least partially overlap. The orthographic projection of the fourth driving electrode block De4 on the base substrate 501 and the orthographic projection of the gate electrode of the driving transistor of the fourth pixel circuit on the base substrate 501 at least partially overlap.

For example, in the direction perpendicular to the surface of the base substrate 501, the pixel circuit of each sub-pixel is located between the intermediate layer and the base substrate 501, and the light-emitting component of each sub-pixel is located on the side of the intermediate layer away from the base substrate 501, that is, the first pixel circuit, the second pixel circuit, the third pixel circuit, and the fourth pixel circuit are all located between the intermediate layer and the base substrate 501, and the first light-emitting component, the second light-emitting component, the third light-emitting component and the fourth light-emitting component are all located on the side of the intermediate layer away from the base substrate 501.

For example, the intermediate layer can be a flat insulating layer. In the direction perpendicular to the surface of the base substrate 501, the first light-emitting voltage applying electrode of the first light-emitting component of the first sub-pixel 5021 is arranged on the side of the light-emitting layer of the first light-emitting component of the first sub-pixel 5021 close to the intermediate layer. The second light-emitting voltage applying electrode of the first light-emitting component of the first sub-pixel 5021 is arranged on the side of the light-emitting layer of the first light-emitting component of the first sub-pixel 5021 away from the intermediate layer. The second light-emitting component in the second sub-pixel 5022, the third light-emitting component in the third sub-pixel 5023, and the fourth light-emitting component in the fourth sub-pixel 5024 have similar layer structures to the first light-emitting component, and will not be repeated here.

For example, as shown in FIG. 13, the intermediate layer comprises a first hole h1, a second hole h2, a third hole h3, a fourth hole h4, and so on.

For example, each pixel circuit may comprise an active semiconductor layer, a gate metal layer, and a source-drain metal layer. In a direction perpendicular to the base substrate 501, the active semiconductor layer is located between the base substrate 501 and the gate metal layer. The gate metal layer is located between the active semiconductor layer and the source-drain metal layer.

For example, in the present disclosure, active layers of respective transistors (for example, the driving transistor M1, the light-emitting control transistor M2, the data writing transistor M3, the threshold compensation transistor M4, the reference voltage writing transistor M5, the first reset transistor M6, the second reset transistor M7, etc.) in the pixel circuit of each sub-pixel are located in the active semiconductor layer, the gate electrodes of the respective transistors in the pixel circuit of each sub-pixel are located in the gate metal layer, and the source electrodes and the drain electrodes of the respective transistors in the pixel circuit are located in the source-drain metal layer. Each active layer may include a source region, a drain region, and a channel region between the source region and the drain region. For example, the active layers of the respective transistors are integrally provided.

For example, the first connection electrode block Ce1 extends to the first hole h1 and is electrically connected to the first pixel circuit of the first sub-pixel 5021 through the first hole h1. For example, the first connection electrode block Ce1 is electrically connected to the second electrode of the light-emitting control transistor of the first pixel circuit of the first sub-pixel through the first hole. For example, the first connection electrode block Ce1 extends to the source-drain metal layer through the first hole h1 to be electrically connected to the second electrode, which is located in the source-drain metal layer, of the light-emitting control transistor of the first pixel circuit.

For example, the second connection electrode block Ce2 extends to the second hole h2 and is electrically connected to the second pixel circuit of the second sub-pixel 5022 through the second hole h2. For example, the second connection electrode block Ce2 is electrically connected to the second electrode of the light-emitting control transistor of the second pixel circuit of the second sub-pixel 5022 through the second hole h2. For example, the second connection electrode block Ce2 extends to the source-drain metal layer through the second hole h2 to be electrically connected to the second electrode, which is located in the source-drain metal layer, of the light-emitting control transistor of the second pixel circuit.

For example, the third connection electrode block Ce3 extends to the third hole h3 and is electrically connected to the third pixel circuit of the third sub-pixel 5023 through the third hole h3. For example, the third connection electrode block Ce3 is electrically connected to the second electrode of the light-emitting control transistor of the third pixel circuit of the third sub-pixel 5023 through the third hole h3. For example, the third connection electrode block Ce3 extends to the source-drain metal layer through the third hole h3 to be electrically connected to the second electrode, which is located in the source-drain metal layer, of the light-emitting control transistor of the third pixel circuit.

For example, the fourth connection electrode block Ce4 extends to the fourth hole h4 and is electrically connected to the fourth pixel circuit of the fourth sub-pixel 5024 through the fourth hole h4. For example, the fourth connection electrode block Ce4 is electrically connected to the second electrode of the light-emitting control transistor of the fourth pixel circuit of the fourth sub-pixel 5024 through the fourth hole h4. For example, the fourth connection electrode block Ce4 extends to the source-drain metal layer through the fourth hole h4 to be electrically connected to the second electrode, which is located in the source-drain metal layer, of the light-emitting control transistor of the fourth pixel circuit.

It should be noted that the connection electrode block of each sub-pixel may cover and fill the corresponding hole. For example, the first connection electrode block Ce1 covers and fills the first hole h1, the second connection electrode block Ce2 covers and fills the second hole h2, the third connection electrode block Ce3 covers and fills the third hole h3, the fourth connection electrode block Ce4 covers and fills the fourth hole h4, however, in order to show the position of each hole, each hole shown in FIG. 13 is located above the corresponding connection electrode block.

For example, the gate electrode of the driving transistor of the pixel circuit (i.e., the first pixel circuit) of the first sub-pixel 5021 and the gate electrode of the driving transistor of the pixel circuit (i.e., the second pixel circuit) of the second sub-pixel 5022 are arranged along the first direction X.

For example, in the first direction X, the second driving electrode block De2 is located on the side of the gate electrode of the driving transistor of the pixel circuit of the second sub-pixel close to the gate electrode of the driving transistor of the pixel circuit of the first sub-pixel. For example, in the first direction X, the second driving electrode block De2 is located between the gate electrode of the driving transistor of the pixel circuit of the first sub-pixel and the gate electrode of the driving transistor of the pixel circuit of the second sub-pixel.

For example, in the first direction X, the second connection electrode block Ce2 is located on the side of the second driving electrode block De2 away from the gate electrode of the driving transistor of the pixel circuit of the first sub-pixel 5021. For example, in the first direction X, the second connection electrode block Ce2 is located between the gate electrode of the driving transistor of the pixel circuit of the first sub-pixel and the gate electrode of the driving transistor of the pixel circuit of the second sub-pixel.

For example, in the first direction X, the first connection electrode block Ce1 is located on the side of the gate electrode of the driving transistor of the pixel circuit of the first sub-pixel 5021 away from the gate electrode of the driving transistor of the pixel circuit of the second sub-pixel 5022.

For example, the distance between the center of the gate electrode of the driving transistor of the pixel circuit of the first sub-pixel 5021 and the center of the first driving electrode block De1 is smaller than the distance between the center of the gate electrode of the driving transistor of the pixel circuit of the second sub-pixel 5022 and the center of the second driving electrode block De2.

It should be noted that in the present disclosure, "center" may refer to the geometric center of the physical shape of the component. In the case of designing the pixel arrangement structure, components such as the gate electrode of the driving transistor and the anode of the light-emitting component are generally designed in regular shapes, such as a rectangle, a hexagon, a pentagon, a trapezoid, or other shapes. In the case of designing, the center of the component (for example, the gate electrode of the driving transistor or the anode of the light-emitting component, etc.) may be the geometric center of the aforementioned regular shape. However, in the actual manufacturing process, the shapes of the formed components, such as the gate electrodes of the driving transistors, the anodes of the light-emitting components, and the like, generally deviate from the regular shapes designed above. For example, the corners of the aforementioned regular shape may become rounded corners. Therefore, the shapes of the components, such as the gate electrode of the driving transistor and the anode of the light-emitting component, may be rounded-corner shapes. In addition, the shapes of the actual manufactured components, such as the gate electrode of the driving transistor and the anode of the light-emitting component, may also have other changes from the designed shapes. For example, the shape of a sub-pixel designed to have a hexagon may become approximately an ellipse in actual manufacturing. Therefore, the centers of the components, such as the gate electrode of the driving transistor and the anode of the light-emitting component, may not be the exact geometric centers of the irregular shapes of the formed components. In the embodiments of the present disclosure, the center of the component may have a certain offset from the geometric center of the shape of the component. In addition, the "center" may also indicate the center of gravity of the component.

For example, as shown in FIG. 4, for the pixel circuit of each sub-pixel, the reference power terminal REF is connected to the reference power line, and the first reset power terminal VINT is connected to the first reset power line. In some embodiments, the gate line G1 and the threshold compensation control line G2 may be the same signal line, the first reset control signal line Rst1 and the second reset control signal line Rst2 may be the same signal line, and the light-emitting control line EM and the reference voltage control line CR can be the same line.

For example, on the base substrate, the gate line G1, the threshold compensation control line G2, the reference voltage control line CR, the first reset control signal line Rst1, the second reset control signal line Rst2, the light-emitting control line EM, the reference power line, the first reset power line are arranged along the first direction X and all extend along the second direction Y.

For example, the gate line G1, the threshold compensation control line G2, the reference voltage control line CR, the first reset control signal line Rst1, the second reset control signal line Rst2, the light-emitting control line EM, the reference power line, and the first reset power line are approximately parallel.

For example, the first power terminal VDD is connected to the first power line, and the first power line and the data line D are approximately parallel to each other. For example, the first power line and the data line D are arranged along the second direction Y, and both extend along the first direction X.

It should be noted that in the present disclosure, "extend" means the general routing direction of each signal line (for example, the first gate signal line, the second gate signal line, the reference control signal line, the light-emitting control signal line, the first reset signal line, the second reset signal line, the initialization signal line, and the reference voltage signal line), and each signal line may not be a straight line microscopically, but extends in the second direction Y in a wave shape.

Figure 14:
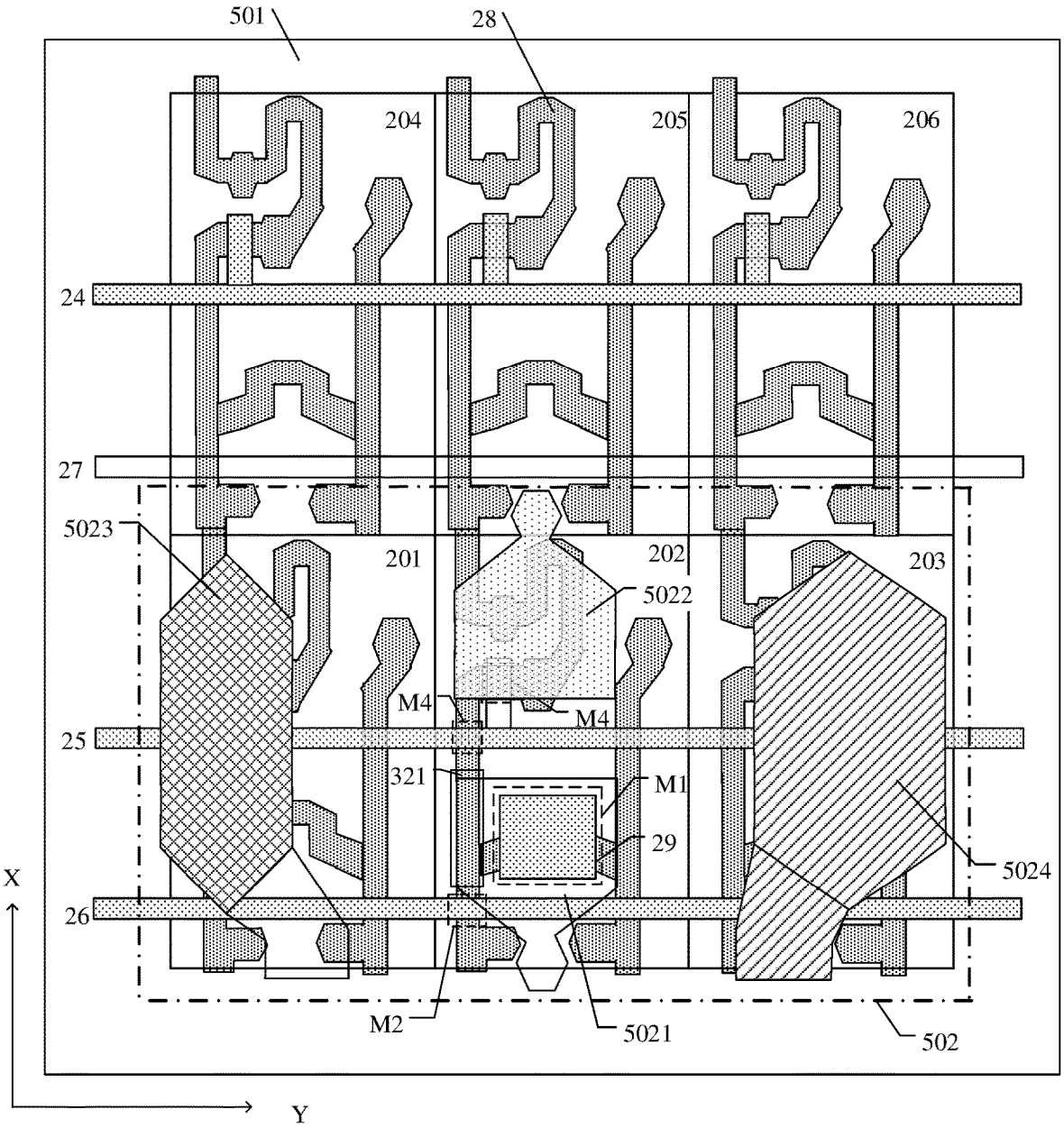
FIG. 14 is a plane partial schematic diagram of another display panel provided by some embodiments of the present disclosure.

FIG. 14 is a plane partial schematic diagram of another display panel provided by some embodiments of the present disclosure.

For example, as shown in FIGS. 14, 201 to 206 can be regions where the pixel circuits of respective sub-pixels on the base substrate 110 are located. For example, in the example shown in FIG. 14, in the repeating unit 502 encircled by a dash dot line, the first pixel circuit of the first sub-pixel 5021 is located in the region 202, the second pixel circuit of the second sub-pixel 5022 is located in the region 205, the third pixel circuit of the third sub-pixel 5023 is located in the region 201, and the fourth pixel circuit of the fourth sub-pixel 5024 is located in the region 203.

For example, as shown in FIG. 14, the active semiconductor layer 28 is located on the base substrate 501, and the shapes of portions of the active semiconductor layer 28 in the regions where the pixel circuits of the respective sub-pixels are located are the same. That is, for example, the shape of the first portion of the active semiconductor layer 28 in the region 202 and the shape of the second portion of the active semiconductor layer 28 in the region 205 are the same.

For example, as shown in FIG. 14, the signal line 25 and the signal line 26 that are electrically connected to the first pixel circuit located in the region 202 extend along the second direction Y, and in the direction perpendicular to the base substrate 501, the signal line 25 and the signal line 26 at least partially overlap the first pixel circuit in the region 202. The signal line 24 and the signal line 27 that are electrically connected to the second pixel circuit located in the region 205 extend along the second direction Y, and in the direction perpendicular to the base substrate 501, the signal line 24 and the signal line 27 at least partially overlap the second pixel circuit in the region 205.

For example, the signal line 24, the signal line 25, the signal line 26, and the signal line 27 are approximately parallel to each other. The signal line 24, the signal line 25, the signal line 26, and the signal line 27 are arranged along the first direction X.

It should be noted that in the example shown in FIG. 14, the gate line G1 and the compensation control line G2 that are electrically connected to the first pixel circuit are the same signal line 25, the reference voltage control line CR and the light-emitting control line EM that are electrically connected to the first pixel circuit are the same signal line 26, that is, the signal line 25 shown in FIG. 14 serves as the gate line G1 electrically connected to the first pixel circuit, and is also multiplexed as the compensation control line G2 electrically connected to the first pixel circuit, and the signal line 26 shown in FIG. 14 not only serves as the reference voltage control line CR electrically connected to the first pixel circuit, but also is multiplexed as the light-emitting control line EM electrically connected to the first pixel circuit. The gate line G1 and the compensation control line G2 that are electrically connected to the second pixel circuit are the same signal line 24, and the reference voltage control line CR and the light-emitting control line EM that are electrically connected to the second pixel circuit are the same signal line 27. That is, the signal line 24 shown in FIG. 14 serves as the gate line G1 electrically connected to the second pixel circuit and is also multiplexed as the compensation control line G2 electrically connected to the second pixel circuit, and the signal line 27 shown in FIG. 14 serves as the reference voltage control line CR electrically connected to the second pixel circuit and is also multiplexed as the light-emitting control line EM electrically connected to the second pixel circuit.

For example, as shown in FIGS. 4, 6, and 14, the first pixel circuit comprises a first capacitor C1. In the first direction X, the first electrode 321 of the first capacitor C1 is located between the signal line 25 and the signal line 26. The orthographic projection of the first electrode 321 of the first capacitor C1 on the base substrate 501 and the orthographic projection of the first light-emitting voltage applying electrode 301 on the base substrate 501 at least partially overlap, for example, the orthographic projection of the first electrode 321 of the first capacitor C1 on the base substrate 501 is located within the orthographic projection of the first light-emitting voltage applying electrode 301 on the base substrate 501. For example, as shown in FIGS. 4 and 14, the first pixel circuit further comprises a driving transistor M1, a light-emitting control transistor M2, a data writing transistor M3, and a threshold compensation transistor M4. The orthographic projection of the second electrode (for example, the drain electrode) of the driving transistor M1 on the base substrate 501, the orthographic projection of the first electrode (for example, the source electrode) of the light-emitting control transistor M2 on the base substrate 501, the orthographic projection of the first electrode (for example, the source electrode) of the threshold compensation transistor M4 on the base substrate 501 at least partially overlap each other.

It should be noted that, in FIG. 14, the regions shown by the rectangular dashed circles respectively indicate the region corresponding to the gate electrode of the driving transistor M1, the region corresponding to the gate electrode of the light-emitting control transistor M2, the region corresponding to the gate electrode of the data writing transistor M3, and the region corresponding to the gate electrode of the threshold compensation transistor M4 on the base substrate 501. For example, it can be seen from FIG. 14 that the orthographic projection of the gate electrode of the driving transistor M1 on the base substrate 501 and the orthographic projection of the anode (i.e., the first light-emitting voltage applying electrode) of the light-emitting component of the first sub-pixel 5021 on the base substrate 501 at least partially overlap. The orthographic projection of the gate electrode of the light-emitting control transistor M2 on the base substrate 501 and the orthographic projection of the signal line 26 on the base substrate 501 at least partially overlap, and orthographic projection of the gate electrode of the threshold compensation transistor M4 is on the base substrate 501 and the orthographic projection of the signal line 25 on the base substrate 501 at least partially overlap. For example, in the direction perpendicular to the base substrate 501, the portion (the portion shown by the rectangular dashed frame corresponding to the light-emitting control transistor M2 in the figure) of the signal line 26 that overlaps the active semiconductor layer 28 comprises the gate electrode of the light-emitting control transistor M2, and the portion (the portion shown by the rectangular dashed frame corresponding to the threshold compensation transistor M4 in the figure) of the signal line 25 that overlaps the active semiconductor layer 28 comprises the gate electrode of the threshold compensation transistor M4.

For example, the gate electrode (an electrode block 29 shown in FIG. 14) of the driving transistor M1 is located on the same layer as the signal line 25 and the signal line 26.

For example, as shown in FIG. 4, FIG. 6, and FIG. 14, in the case where the first pixel circuit comprises a first capacitor C1, a threshold compensation transistor M4, and a light-emitting control transistor M2, in the first direction X, the orthographic projection of the first electrode 321 of the first capacitor C1 on the base substrate 501 is located between the orthographic projection of the gate electrode of the threshold compensation transistor M4 on the base substrate 501 and the orthographic projection of the gate electrode of the light-emitting control transistor M2 on the base substrate 501.

For example, as shown in FIG. 14, the orthographic projection of the first electrode 321 of the first capacitor C1 on the base substrate 501 and the orthographic projection of a part of the active semiconductor layer 28 between the active layer of the threshold compensation transistor M4 and the active layer of the light-emitting control transistor M2 on the base substrate 501 at least partially overlap.

For example, in some examples, the second electrode of the driving transistor M1, the first electrode of the light-emitting control transistor M2, and the first electrode of the threshold compensation transistor M4 may be integrally provided.

For example, the orthographic projection of the first electrode 321 of the first capacitor C1 on the base substrate 501 and the orthographic projection of the second electrode of the driving transistor M1 on the base substrate 501 at least partially overlap. For example, in some embodiments, the orthographic projection of the second electrode of the driving transistor M1 on the base substrate 501 is located within the orthographic projection of the first electrode 321 of the first capacitor C1 on the base substrate 501.

For example, the shape of the first electrode 321 of the first capacitor C1 may be a rectangle, and the long side of the rectangle may be approximately parallel to the first direction X, for example.

For example, the first electrode 321 of the first capacitor C1, the second electrode of the driving transistor M1, the first electrode of the light-emitting control transistor M2, and the first electrode of the threshold compensation transistor M4 are all electrically connected. In some embodiments, the metal layer used to form the first electrode 321 of the first capacitor C1 is directly formed on the second electrode of the driving transistor M1, so as to electrically connect the first electrode 321 of the first capacitor C1 to the second electrode of the driving transistor M1. In other embodiments, there is an insulating layer between the first electrode 321 of the first capacitor C1 and the second electrode of the driving transistor M1, and the first electrode 321 of the first capacitor C1 is electrically connected to the second electrode of the driving transistor M1 through the hole in the insulating layer.

For example, in the repeating unit 502, the data writing sub-circuit of the pixel circuit of the first sub-pixel 5021, the data writing sub-circuit of the pixel circuit of the third sub-pixel 5023, and the data writing sub-circuit of the pixel circuit of the fourth sub-pixel 5024 are all electrically connected to, for example, the N-th row gate line to receive the scan signal, and the pixel circuit of the second sub-pixel 5022 is electrically connected to the (N−1)-th row gate line to receive the scan signal. The (N−1)-th row gate line is the upper gate line adjacent to the N-th row gate line. N is a positive integer greater than 1. For example, as shown in FIG. 14, the signal line 24 may represent the (N−1)-th row gate line, and the signal line 25 may represent the N-th row gate line. In the first direction X, the (N−1)-th row gate line (i.e., the signal line 24) is located on the side of the signal line 25 away from the signal line 26, and the orthographic projection of the N-th row gate line (i.e., the signal line 25) on the base substrate 501 at least partially overlaps the region 201, the region 202, the region 203. The orthographic projection of the (N−1)-th row gate line (i.e., the signal line 24) on the base substrate 501 at least partially overlaps the region 204, the region 205, the region 206.

For example, the signal line 26 may represent the N-th row reference voltage control line/light-emitting control line, the signal line 27 may represent the (N−1)-th row reference voltage control line/light-emitting control line, the orthographic projection of the N-th row reference voltage control line/light-emitting control line (i.e., the signal line 26) on the base substrate 501 at least partially overlaps the region 201, the region 202, and the region 203, and the orthographic projection of the (N−1)-th row reference voltage control line/light-emitting control line (i.e., the signal line 27) on the base substrate 501 at least partially overlaps the region 204, the region 205, and the region 206.

For example, the display panel 500 may be an organic light-emitting diode (OLED) display panel or the like.

For example, the display panel 500 may be a rectangular panel, a circular panel, an oval panel, a polygonal panel, or the like. In addition, the display panel 500 may not only be a flat panel, but also a curved panel or even a spherical panel.

For example, the display panel 500 may also have a touch function, that is, the display panel 500 may be a touch display panel.

For example, the display panel 500 may be applied to any products or components with display functions such as mobile phones, tablet computers, televisions, monitors, notebook computers, digital photo frames, and navigators.

For the present disclosure, the following statements should be noted:

(1) The accompanying drawings of the embodiment(s) of the present disclosure involve only the structure(s) in connection with the embodiment(s) of the present disclosure, and other structure(s) can refer to common design(s).

(2) For the purpose of clarity only, in the accompanying drawings for illustrating the embodiment(s) of the present disclosure, the thickness and size of a layer or a structure may be enlarged. It should understood that, in the case in which a component or an element, such as a layer, a film, a region, a substrate, or the like, is referred to as being "on" or "under" another component or element, the component or the element may be "directly" "on" or "under" the another component or element or a component or element is interposed therebetween.

(3) In case of no conflict, the embodiments of the present disclosure and the features in the embodiment(s) can be combined with each other to obtain new embodiment(s).

What have been described above are only specific implementations of the present disclosure, the protection scope of the present disclosure is not limited thereto, and the protection scope of the present disclosure should be based on the protection scope of the claims.

What is claimed is:

1. A pixel circuit, comprising: a driving sub-circuit, a light-emitting control sub-circuit, a data writing sub-circuit, a storage sub-circuit, and a first compensation sub-circuit, wherein the data writing sub-circuit is configured to write a data voltage into the storage sub-circuit under control of a scan signal;

the storage sub-circuit is configured to store the data voltage;

the driving sub-circuit is electrically connected to a first node, a light-emitting component is electrically connected to a second node, the driving sub-circuit is configured to drive the light-emitting component to emit light according to the data voltage;

the light-emitting control sub-circuit is electrically connected to the first node and the second node, respectively, and the light-emitting control sub-circuit is configured to achieve to turn on or turn off connection between the driving sub-circuit and the light-emitting component; and the first compensation sub-circuit is electrically connected to the first node and the second node, respectively, and is configured to compensate an electrical level of the second node according to an electrical level of the first node, so as to increase the electrical level of the second node;

the pixel circuit is arranged on a base substrate, the first compensation sub-circuit comprises a first capacitor, the first capacitor comprises a first electrode and a second electrode, the first electrode of the first capacitor is electrically connected to the first node, and the second electrode of the first capacitor is electrically connected to the second node;

the light-emitting control sub-circuit comprises a light-emitting control transistor, a first electrode of the light-emitting control transistor is electrically connected to the first node, a second electrode of the light-emitting control transistor is electrically connected to the second node, and a gate electrode of the light-emitting control transistor is configured to receive a light-emitting control signal;

the driving sub-circuit is also electrically connected to a third node, the pixel circuit further comprises a second compensation sub-circuit, the second compensation sub-circuit is configured to receive a threshold compensation control signal, and write a threshold compensation voltage to the third node according to the threshold compensation control signal;

the second compensation sub-circuit comprises a threshold compensation transistor, an orthographic projection of the first electrode of the first capacitor on the base substrate, an orthographic projection of a gate electrode of the threshold compensation transistor on the base substrate, and an orthographic projection of the gate electrode of the light-emitting control transistor on the base substrate are arranged along a first direction, in the first direction, the orthographic projection of the first electrode of the first capacitor on the base substrate is located between the orthographic projection of the gate electrode of the threshold compensation transistor on the base substrate and the orthographic projection of the gate electrode of the light-emitting control transistor on the base substrate.

2. The pixel circuit according to claim 1, wherein the driving sub-circuit comprises a driving transistor, a first electrode of the driving transistor is electrically connected to a first power terminal, a second electrode of the driving transistor is electrically connected to the first node, a gate electrode of the driving transistor is electrically connected to the third node.

3. The pixel circuit according to claim 2, wherein the data writing sub-circuit comprises a data writing transistor, the storage sub-circuit comprises a second capacitor, a first electrode of the data writing transistor is configured to receive the data voltage, a second electrode of the data writing transistor is electrically connected to a first end of the second capacitor, a gate electrode of the data writing transistor is configured to receive the scan signal; and a second end of the second capacitor is electrically connected to the third node.

4. The pixel circuit according to claim 3, further comprising a reference voltage writing sub-circuit, wherein the reference voltage writing sub-circuit is configured to receive a reference voltage control signal, and write a reference voltage to the first end of the second capacitor according to the reference voltage control signal.

5. The pixel circuit according to claim 2, further comprising a first reset sub-circuit, wherein the first reset sub-circuit is configured to receive a first reset control signal and write a first reset voltage to the third node according to the first reset control signal.

6. The pixel circuit according to claim 1, further comprising a reference voltage writing sub-circuit, a first reset sub-circuit, and a second reset sub-circuit, wherein the driving sub-circuit comprises a driving transistor, the data writing sub-circuit comprises a data writing transistor, the storage sub-circuit comprises a second capacitor, the reference voltage writing sub-circuit comprises a reference voltage writing transistor, the first reset sub-circuit comprises a first reset transistor, the second reset sub-circuit comprises a second reset transistor, a first electrode of the driving transistor is electrically connected to a first power terminal, a second electrode of the driving transistor is electrically connected to the first node, and a gate electrode of the driving transistor is electrically connected to the third node;

a first light-emitting voltage applying electrode of the light-emitting component is electrically connected to the second node, and a second light-emitting voltage applying electrode of the light-emitting component is electrically connected to a second power terminal, a first electrode of the data writing transistor is configured to receive the data voltage, a second electrode of the data writing transistor is electrically connected to a first end of the second capacitor, and a gate electrode of the data writing transistor is configured to receive the scan signal, a second end of the second capacitor is electrically connected to the third node, a first electrode of the threshold compensation transistor is electrically connected to the first node, a second electrode of the threshold compensation transistor is electrically connected to the third node, and the gate electrode of the threshold compensation transistor is configured to receive a threshold compensation control signal;

a first electrode of the reference voltage writing transistor is configured to receive a reference voltage, a second electrode of the reference voltage writing transistor is electrically connected to the first end of the second capacitor, and a gate electrode of the reference voltage writing transistor is configured to receive a reference voltage control signal;

a first electrode of the first reset transistor is configured to receive a first reset voltage, a second electrode of the first reset transistor is electrically connected to the third node, and a gate electrode of the first reset transistor is configured to receive a first reset control signal;

a first electrode of the second reset transistor is electrically connected to the first power terminal, a second electrode of the second reset transistor is electrically connected to the first end of the second capacitor, and a gate electrode of the second reset transistor is configured to receive a second reset control signal.

7. A driving method of the pixel circuit according to claim 1, wherein the driving method comprises:

in a data writing stage, writing the data voltage to the driving sub-circuit, and compensating the electrical level of the second node according to the electrical level of the first node;

in a light-emitting stage, driving the light-emitting component to emit light by the driving sub-circuit according to the data voltage.

8. A display panel, comprising a base substrate and a plurality of repeating units on the base substrate, wherein each repeating unit in the plurality of repeating units comprises a first sub-pixel and a second sub-pixel, the first sub-pixel comprises a first light-emitting component and a first pixel circuit, the first pixel circuit is the pixel circuit according to claim 1, and the first light-emitting component is a light-emitting component driven by the first pixel circuit.

9. The display panel according to claim 8, wherein the second sub-pixel comprises a second light-emitting component and a second pixel circuit, the second pixel circuit is configured to drive the second light-emitting component to emit, in a direction perpendicular to the base substrate, a driving sub-circuit in the first pixel circuit is located between the first light-emitting component and the base substrate, and a driving sub-circuit in the second pixel circuit is located between the second light-emitting component and the base substrate, an orthographic projection of the driving sub-circuit in the first pixel circuit on the base substrate and an orthographic projection of the first light-emitting component on the base substrate at least partially overlap, and an orthographic projection of the driving sub-circuit in the second pixel circuit on the base substrate and an orthographic projection of the second light-emitting component on the base substrate do not overlap.

10. The display panel according to claim 9, wherein the orthographic projection of the driving sub-circuit in the first pixel circuit on the base substrate is within the orthographic projection of the first light-emitting component on the base substrate.

11. The display panel according to claim 8, wherein the each repeating unit further comprises a third sub-pixel and a fourth pixel, the first sub-pixel and the second sub-pixel are both green sub-pixels, the third sub-pixel is a red sub-pixel, and the fourth sub-pixel is a blue sub-pixel.

12. The display panel according to claim 8, wherein the each repeating unit further comprises a third sub-pixel and a fourth pixel, in the each repeating unit, the first sub-pixel and the second sub-pixel are arranged along the first direction, the third sub-pixel and the fourth sub-pixel are arranged along a second direction, the first direction and the second direction are respectively two directions perpendicular to each other in a same plane.

13. The display panel according to claim 12, wherein the plurality of repeating units are arranged along the second direction to form a plurality of repeating unit groups, the plurality of repeating unit groups are arranged along the first direction.

14. A display substrate, comprising: a base substrate, a pixel circuit, and a light-emitting component, wherein the pixel circuit comprises: a driving sub-circuit, a light-emitting control sub-circuit, a data writing sub-circuit, a storage sub-circuit, and a first compensation sub-circuit, the data writing sub-circuit is configured to write a data voltage into the storage sub-circuit under control of a scan signal;

the storage sub-circuit is configured to store the data voltage;

the driving sub-circuit is electrically connected to a first node, the light-emitting component is electrically connected to a second node, the driving sub-circuit is configured to drive the light-emitting component to emit light according to the data voltage;

the light-emitting control sub-circuit is electrically connected to the first node and the second node, respectively, and the light-emitting control sub-circuit is configured to achieve to turn on or turn off connection between the driving sub-circuit and the light-emitting component; and the first compensation sub-circuit is electrically connected to the first node and the second node, respectively, and is configured to compensate an electrical level of the second node according to an electrical level of the first node, so as to increase the electrical level of the second node, the light-emitting component and the pixel circuit are arranged on the base substrate;

the first compensation sub-circuit comprises a first capacitor, the first capacitor comprises a first electrode and a second electrode, the first electrode of the first capacitor is electrically connected to the first node, and the second electrode of the first capacitor is electrically connected to the second node;

the light-emitting control sub-circuit comprises a light-emitting control transistor, a first electrode of the light-emitting control transistor is electrically connected to the first node, a second electrode of the light-emitting control transistor is electrically connected to the second node, and a gate electrode of the light-emitting control transistor is configured to receive a light-emitting control signal;

the driving sub-circuit is also electrically connected to a third node, the pixel circuit further comprises a second compensation sub-circuit, the second compensation sub-circuit is configured to receive a threshold compensation control signal, and write a threshold compensation voltage to the third node according to the threshold compensation control signal;

the second compensation sub-circuit comprises a threshold compensation transistor, an orthographic projection of the first electrode of the first capacitor on the base substrate, an orthographic projection of a gate electrode of the threshold compensation transistor on the base substrate, and an orthographic projection of the gate electrode of the light-emitting control transistor on the base substrate are arranged along a first direction, in the first direction, the orthographic projection of the first electrode of the first capacitor on the base substrate is located between the orthographic projection of the gate electrode of the threshold compensation transistor on the base substrate and the orthographic projection of the gate electrode of the light-emitting control transistor on the base substrate.

15. The display substrate according to claim 14, wherein the light-emitting component comprises a first light-emitting voltage applying electrode, a second light-emitting voltage applying electrode, and a light-emitting layer arranged between the first light-emitting voltage applying electrode and the second light-emitting voltage applying electrode, the second electrode of the first capacitor and the first light-emitting voltage applying electrode are provided integrally, in a direction perpendicular to the base substrate, the first electrode of the first capacitor is located between the first light-emitting voltage applying electrode and the base substrate, and the first light-emitting voltage applying electrode is located between the first electrode of the first capacitor and the light-emitting layer.

16. The display substrate according to claim 15, wherein the orthographic projection of the first electrode of the first capacitor on the base substrate and an orthographic projection of the first light-emitting voltage applying electrode on the base substrate at least partially overlap.

17. A display panel, comprising:

a base substrate and a plurality of repeating units on the base substrate, wherein each repeating unit in the plurality of repeating units comprises a first sub-pixel and a second sub-pixel, the first sub-pixel comprises a first light-emitting component and a first pixel circuit, the first light-emitting component is driven by the first pixel circuit; the first pixel circuit comprises: a driving sub-circuit, a light-emitting control sub-circuit, a data writing sub-circuit, a storage sub-circuit, and a first compensation sub-circuit, the data writing sub-circuit is configured to write a data voltage into the storage sub-circuit under control of a scan signal; the storage sub-circuit is configured to store the data voltage; the driving sub-circuit is electrically connected to a first node, the first light-emitting component is electrically connected to a second node, the driving sub-circuit is configured to drive the first light-emitting component to emit light according to the data voltage; the light-emitting control sub-circuit is electrically connected to the first node and the second node, respectively, and the light-emitting control sub-circuit is configured to achieve to turn on or turn off connection between the driving sub-circuit and the first light-emitting component; and the first compensation sub-circuit is electrically connected to the first node and the second node, respectively, and is configured to compensate an electrical level of the second node according to an electrical level of the first node; the second sub-pixel comprises a second light-emitting component and a second pixel circuit, the second pixel circuit is configured to drive the second light-emitting component to emit, in a direction perpendicular to the base substrate, a driving sub-circuit in the first pixel circuit is located between the first light-emitting component and the base substrate, and a driving sub-circuit in the second pixel circuit is located between the second light-emitting component and the base substrate, an orthographic projection of the driving sub-circuit in the first pixel circuit on the base substrate and an orthographic projection of the first light-emitting component on the base substrate at least partially overlap, and an orthographic projection of the driving sub-circuit in the second pixel circuit on the base substrate and an orthographic projection of the second light-emitting component on the base substrate do not overlap.

18. The display panel according to claim 17, wherein the orthographic projection of the driving sub-circuit in the first pixel circuit on the base substrate is within the orthographic projection of the first light-emitting component on the base substrate.

* * * * *